US007401885B2

(12) United States Patent
Yamazaki et al.

(10) Patent No.: US 7,401,885 B2
(45) Date of Patent: Jul. 22, 2008

(54) DROPLET DISCHARGE APPARATUS

(75) Inventors: Shunpei Yamazaki, Tokyo (JP); Osamu Nakamura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 397 days.

(21) Appl. No.: 11/197,835

(22) Filed: Aug. 5, 2005

(65) Prior Publication Data

US 2006/0028503 A1 Feb. 9, 2006

(30) Foreign Application Priority Data

Aug. 23, 2004 (JP) ..... 2004-242862

(51) Int. Cl.
*B41J 2/015* (2006.01)
*B41J 2/14* (2006.01)
*B41J 2/175* (2006.01)

(52) U.S. Cl. ..... 347/20; 347/47; 347/85

(58) Field of Classification Search ..... 347/42, 347/43, 45, 47, 54, 68, 85
See application file for complete search history.

(56) References Cited

U.S. PATENT DOCUMENTS 5,600,357 A * 2/1997 Usui et al. ..... 347/72
5,706,039 A * 1/1998 Chamberlain et al. ..... 347/47
6,010,254 A * 1/2000 Sanada ..... 396/604
6,063,339 A 5/2000 Tisone et al. ..... 422/67
6,145,954 A * 11/2000 Moore ..... 347/28
2002/0159919 A1 10/2002 Churchill et al. ..... 422/100
2003/0151637 A1 8/2003 Nakamura et al. ..... 347/20
2004/0072364 A1 4/2004 Tisone et al. ..... 436/180

FOREIGN PATENT DOCUMENTS

JP 09-290505 11/1997

* cited by examiner

*Primary Examiner*—Shih-Wen Hsieh
(74) *Attorney, Agent, or Firm*—Cook, Alex, McFarron, Manzo, Cummings & Mehler, Ltd.

(57) ABSTRACT

An object of the invention is to provide a droplet discharge apparatus which does not cause defective discharge due to drying, solidification, or the like of a composition in discharging the composition from a nozzle. One feature of the invention is to comprise a nozzle portion provided with a nozzle hole for discharging a composition, a piezo method for discharging the composition from the nozzle hole, a channel for supplying the composition to the bottom surface of the nozzle portion, wherein lyophilic treatment is performed on the bottom surface of the nozzle portion.

23 Claims, 14 Drawing Sheets

DROPLET DISCHARGE APPARATUS

BACKGROUND OF THE INVENTION

1. Field of the Invention

The present invention relates to an apparatus for discharging droplets, and particularly to a droplet discharge apparatus which prevents defective discharge due to drying or solidification of a composition to be discharged.

2. Description of the Related Art

In recent years, research on directly drawing a circuit pattern over a substrate using a semiconductor material, a metal material, or an insulating material, so-called direct drawing, has been conducted actively. It is specifically intended that an electronic circuit be drawn and an electronic device be printed using an apparatus having a droplet discharging means, as if characters are printed out by a printer.

A conventional method for manufacturing an electronic device includes a considerably complicated process in forming a pattern of a circuit or the like. For example, in the case of forming one wiring, a film of a semiconductor material or a metal material to be a wiring is formed over a substrate; a region of the film to be used for the wiring is specified and provided with a resist or the like; lastly, the other part of the film is removed by etching or the like while leaving the specified region unremoved. This process is repeated to form a desired circuit pattern. However, such a process has a large number of steps and a step of forming or removing a film needs to be performed in vacuum. Therefore, heavy use of a huge expensive vacuum apparatus increases manufacturing cost.

On the other hand, in the case of using the direct drawing, a circuit pattern such as a wiring can be directly formed. Thus, a conventional three-stage process can be replaced by a one-stage process. Since the circuit pattern can be manufactured under atmospheric pressure, and a vacuum apparatus is unnecessary, drastic cost reduction can be achieved. Therefore, direct drawing with the use of a droplet discharge apparatus attracts considerable attention.

The above-described direct drawing is performed using, for example, a droplet discharge apparatus such as an inkjet apparatus. But, in the case of discharging a high-viscosity material or the like by a droplet discharge apparatus, defective discharge caused by drying of the material or the like has become a problem. Therefore, various solutions have been searched for in order to solve the defective discharge.

For example, there is a method in which a head having a discharge opening is wiped with a solvent such as an organic solvent or a discharge solution itself before discharging a material, a method in which an entire head is capped and then soaked into a solvent, or a method in which a head is placed in space filled with solvent vapor. Alternatively, there is also a method in which a moisturizing agent is added to a liquid to be discharged or a meniscus control method in which drying or solidification is prevented by vibrating and agitating a liquid with pulse voltage, not so high as to discharge a liquid, applied to a piezoelectric element (for example, Reference 1: Japanese Patent Application Laid-Open No. 9-290505).

Although the method in which a head is wiped before discharging a material, an entire head is capped and then soaked into a solvent, or a head is placed in space filled with vapor is effective against defective discharge before printing, it cannot deal with defective discharge in the process of printing. In other words, in drawing a pattern, an unused nozzle among a plurality of nozzles in a droplet discharge apparatus (a nozzle not discharging a droplet) does not perform discharge for a certain period. Therefore, defective discharge may be caused by drying or solidification of a material. As a more highly-volatile solvent is used, a material has higher viscosity due to evaporation of the solvent, and the possibility of defective discharge becomes noticeable.

In order to prevent this, the method in which a moisturizing agent is added to a liquid or the meniscus control method can be used; however, the method in which a moisturizing agent is added may include the case where there is no appropriate moisturizing agent depending on a material. The meniscus control method has a problem in that material viscosity increases due to solvent evaporation over time. Consequently, a change in discharge conditions is caused and the discharge amount or discharge position of the material cannot be controlled precisely. Thus, neither method has reached a fundamental solution.

SUMMARY OF THE INVENTION

In view of the above-described problems, it is an object of the present invention to provide a droplet discharge apparatus having a nozzle which does not cause defective discharge in discharging droplets.

According to the invention, defective discharge due to drying and solidification of a composition in a nozzle is prevented in a droplet discharge apparatus. Note that the term "defective discharge" here refers to not only the case where a composition is not discharged at all but also the case where the amount or direction of a liquid to be discharged cannot be controlled precisely due to drying or solidification of a composition. The droplet discharge apparatus is an apparatus for selectively discharging (spraying) droplets (also referred to as dots) of a composition including a material of a conductive film, an insulating film, or the like to form the film in an arbitrary position, and is also referred to as an inkjet apparatus depending on its mode.

One feature of a droplet discharge apparatus according to the invention is to include a nozzle portion provided with a nozzle hole for discharging a composition, a pressurizing means for discharging the composition from the nozzle hole, and a means for supplying the composition to a bottom surface of the nozzle portion, wherein lyophilic treatment is performed on the bottom surface of the nozzle portion. As the composition, any material may be used as long as it can be discharged from the nozzle hole, and a metal material, an insulating material, or the like can be used. As the pressurizing means for discharging the composition, a piezo method in which a piezoelectric element is provided and deformed by applying voltage thereto to extrude a composition, a thermal inkjet method in which a composition is extruded by making a heating element generate heat to produce bubbles, or the like can be used. The "lyophilic treatment" here means making the bottom surface of the nozzle portion have an affinity in which the composition is not repelled by the bottom surface.

As the means for supplying the composition to the bottom surface of the nozzle portion, a channel through which the composition can flow is provided in the nozzle portion. Then, the composition is supplied to the bottom surface of the nozzle portion by flowing the composition through the channel. The channel may have a structure for suctioning the composition on the bottom surface of the nozzle portion as well as supplying the composition to the bottom surface of the nozzle portion. Therefore, the channel is preferably provided with a liquid sending means for extruding and supplying the composition to the bottom surface of the nozzle portion or a liquid return means for suctioning and recovering the composition from the bottom surface of the nozzle portion.

The structure can be applied, in the same manner, to a droplet discharge apparatus provided with a plurality of nozzle holes. In this case, channels may each be provided between the plurality of nozzle holes, or when a plurality of nozzle holes is arranged in a linear shape, a long channel may be provided parallel to the sequence of the nozzle holes. Note that "arranging in a linear shape" includes not only the state in which nozzle holes are aligned but also the state in which nozzle holes are arranged regularly and linearly, for example, the state in which nozzle holes are alternatively arranged in zigzag.

Another feature of a droplet discharge apparatus according to the invention is to include a nozzle portion provided with a nozzle hole for discharging a composition, a pressurizing means for discharging the composition from the nozzle hole, and a first channel and a second channel each connected to a side wall of the nozzle hole, wherein the composition is exchanged between the nozzle hole and the first channel and between the nozzle hole and the second channel. The exchange of the composition between the nozzle hole and the first channel or between the nozzle hole and the second channel means exchange in the case of supplying the composition to the nozzle hole from the first channel or the second channel and in the case of suctioning the composition in the nozzle hole into the first channel or the second channel. Note that either or both of the first channel and the second channel are preferably provided with a liquid sending means for extruding and supplying the composition to the nozzle hole or a liquid return means for suctioning and recovering the composition from the nozzle hole. This structure can be applied, in the same manner, to a droplet discharge apparatus provided with a plurality of nozzle holes. In this case, channels may each be provided to connect adjacent nozzle holes to each other, or the first channel or the second channel may be provided so as to be shared by the plurality of nozzle holes. Further, on-off valves may be provided in a connection portion of the nozzle hole and the first channel and a connection portion of the nozzle hole and the second channel.

Still another feature of a droplet discharge apparatus according to the invention is to include a nozzle portion provided with a nozzle hole for discharging a composition, a compression chamber connected to the nozzle hole, a channel provided to connect to two different positions of a side wall of the compression chamber, a first pressurizing means provided on a side wall of the compression chamber, and a second pressurizing means provided on a side wall of the channel, wherein an on-off valve is provided in a connection portion of the compression chamber and the channel. Another channel may also be provided in order to externally supply a composition to the channel.

According to the invention, drying or solidification of a composition to be discharged from a nozzle hole can be prevented in a droplet discharge apparatus; thus, a composition can be discharged without causing defective discharge.

DETAILED DESCRIPTION OF THE INVENTION

Figure 1A:
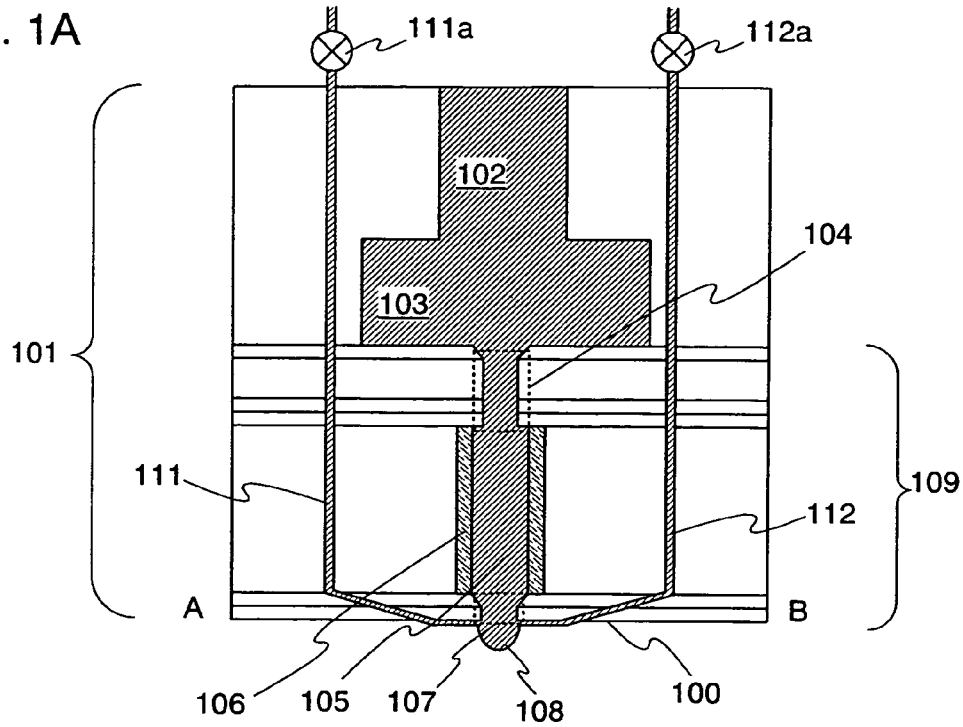
FIGS. 1A to 1C show a droplet discharge means.

Hereinafter, embodiment modes of the present invention will be explained with reference to the drawings. However, the present invention is not limited to the following explanation. As is easily known to a person skilled in the art, the mode and the detail of the invention can be variously changed without departing from the purpose and the scope of the present invention. Thus, the present invention is not interpreted while limiting to the following description of the embodiment mode. In the structure of the invention explained below, the same reference numeral is commonly used to denote the same component in the drawings.

In a droplet discharge apparatus, a composition existing in a nozzle hole which is an outlet for discharging the composition generally tends to be dried and solidified since it is always exposed to air. In the case of discharging a composition continuously, the composition is replaced every time it is discharged; thus, the problem of drying or the like is not caused. However, when a composition is not discharged for a certain period, a problem of composition drying is caused.

Particularly when a highly-volatile solvent is used in a composition, drying is more significant; thus, there is a very high possibility of a clogged nozzle hole due to solidification of the composition. Even if the composition is not solidified, the viscosity of the composition increases due to solvent evaporation and landing accuracy such as a direction has a problem at the time of discharge. Therefore, in order to prevent such a problem, a droplet discharge apparatus according to the invention has a structure for preventing the composition in a nozzle hole from drying.

Specifically, the same composition as that discharged from a nozzle hole is supplied to a bottom surface of a nozzle, and at least the nozzle hole and a peripheral bottom surface of the nozzle are covered with the composition. As a means for supplying the composition to the bottom surface of the nozzle, for example, a channel connected to the bottom surface of the nozzle is provided on the bottom surface of the nozzle separately from the nozzle hole. Drying can be prevented by supplying the composition from the channel and covering the bottom surface of the nozzle with the composition. In this case, the bottom surface of the nozzle is preferably put into a state of not repelling the composition (lyophilic).

As another structure according to the invention, a channel connected to a side wall of a nozzle hole is provided, and a composition is supplied directly to the nozzle hole from the channel. Direct exchange of the composition between the nozzle hole and the channel makes the composition in the nozzle hole flow and replaced constantly. Thus, the composition can be prevented from drying and solidifying.

As still another structure according to the invention, a circulation channel provided on a side wall of a compression chamber which is connected to a nozzle hole, and the composition in the nozzle hole is made to flow by using the circulation channel. The flow of the composition can be controlled by selectively applying voltage to each piezoelectric element provided on the side wall of the compression chamber and the circulation channel and deforming the compression chamber and the circulation channel.

Structures of a droplet discharge apparatus according to the invention will be specifically explained below with reference to the drawings.

Embodiment Mode 1

In this embodiment mode, a droplet discharge apparatus, in which a bottom surface of a nozzle having a nozzle hole for discharging a composition is provided with a means for supplying a composition, will be explained with reference to drawings.

Figure 1B:
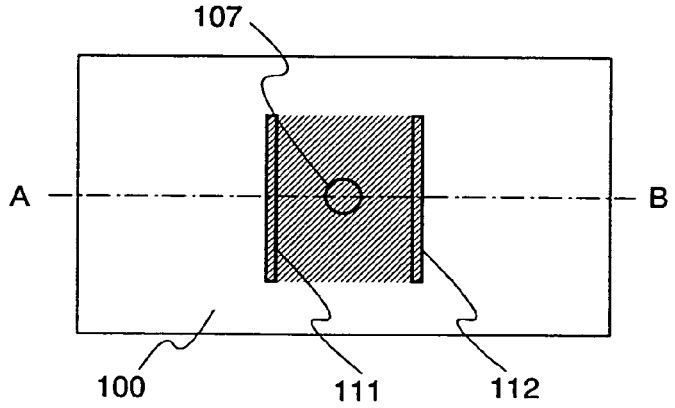
Figure 1C:
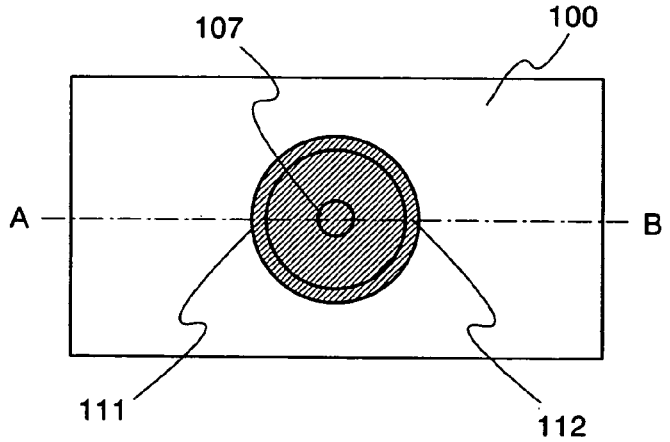

FIGS. 1A to 1C show the structure of a droplet discharge means in a droplet discharge apparatus. A droplet discharge means 101 includes an auxiliary liquid chamber 103 connected to a liquid chamber channel 102; a nozzle portion 109 having a fluid resistance portion 104, a compression chamber 105, a piezoelectric element 106, and a nozzle hole 107; and channels 111 and 112 which are means for supplying a composition to a bottom surface 100 of the nozzle portion 109.

After a composition externally supplied into the droplet discharge means 101 passes through the liquid chamber channel 102 and is stored in the auxiliary liquid chamber 103, the composition moves to the nozzle portion 109 for discharging the composition. In the nozzle portion 109, the compression chamber 105 is filled with a moderate amount of the composition by the fluid resistance portion 104.

The piezoelectric element 106 which deforms by applying voltage is provided on the side wall of the compression chamber 105. As the piezoelectric element 106, a piezoelectric element having a piezoelectric effect of, for example, lead zirconate titanate (PZT) or the like can be used. By applying voltage to the piezoelectric element 106 arranged in a desired nozzle, the composition in the compression chamber 105 can be extruded and the composition 108 can be externally discharged.

The composition on the outermost surface of the nozzle hole 107 generally tends to be dried since the composition is exposed to air. In the case of discharging the composition from the nozzle hole 107, the composition is replaced; thus, the problem of drying is not caused. However, when the composition is not discharged for a certain period, there is a possibility of the composition drying and solidification. Therefore, the droplet discharge means 101 shown in FIGS. 1A to 1C is provided with the channels 111 and 112 to prevent the composition on the outermost surface of the nozzle hole 107 from drying. The same composition as that discharged from the nozzle hole 107 is supplied to the bottom surface 100 of the nozzle portion 109 with the use of the channels 111 and 112, and the nozzle hole 107 and the bottom surface 100 of the nozzle portion on the periphery of the nozzle hole 107 are covered with the composition (FIG. 1A).

By using such a structure, a new composition is constantly supplied to the nozzle hole 107; thus, the composition in the nozzle hole 107 can be prevented from drying. Note that the same composition as that discharged from the nozzle hole 107 is supplied to the bottom surface 100 of the nozzle portion through the channels 111 and 112; however, the invention is not limited thereto. A solvent of the composition, a solution for preventing drying, or the like may alternatively be supplied.

The channels 111 and 112 may have any shape or arrangement as long as the composition can be supplied to the bottom surface 100 of the nozzle portion. For example, they may be formed in linear shapes in the vicinity of the nozzle hole 107 (FIG. 1B) or may be formed in circular shapes (including annular or ring-like shapes) around the nozzle hole 107 (FIG. 1C). One nozzle hole may be provided with a single channel or a plurality of channels. Further, the channels are preferably provided diagonally to the bottom surface 100 of the nozzle portion toward the nozzle hole 107 as shown in FIG. 1A, since the composition supplied through the channels 111 and 112 can easily flow toward the nozzle hole 107. Note that FIGS. 1B and 1C schematically show the bottom surface of the droplet discharge means 101 in FIG. 1A, and a cross section taken along line A-B in FIGS. 1B and 1C corresponds to FIG. 1A.

The channels 111 and 112 may be provided with a means for sending and supplying the composition (liquid sending means) or a means for suctioning and recovering the composition (liquid return means). As the liquid sending means or the liquid return means of the composition, a pump, a screw, or the like can be used. Here, as shown in FIG. 1A, end portions of the channels 111 and 112 opposite to end portions connected to the bottom surface 100 of the nozzle portion are provided with pumps 111*a* and 112*a* having a liquid sending means or a liquid returning means; accordingly, the composition flow in the channels 111 and 112 can be controlled.

In this case, the composition flow can be selectively controlled by providing the pumps 111*a* and 112*a* with the liquid sending means or the liquid returning means. For example, when each of the pumps 111*a* and 112*a* is provided with the liquid sending means, the composition can be supplied to the bottom surface 100 of the nozzle portion through the channels 111 and 112. When one of the pumps 111*a* and 112*a* is provided with the liquid sending means and the other is provided with the liquid return means, the composition can flow and move in a particular direction on the bottom surface 100 of the nozzle portion.

The composition may be supplied to the channels 111 and 112 by separately and externally providing a liquid chamber for supply or by connecting the auxiliary liquid chamber 103 to the channels 111 and 112.

The composition supplied through the channels 111 and 112 to the bottom surface 100 of the nozzle portion is required not to drop. Therefore, the bottom surface 100 of the nozzle portion is preferably put in a state of not repelling the composition (lyophilic state) in advance. In addition, the composition is controlled by a pump having a liquid sending means or a liquid return means, or the like so as to prevent the composition from being excessively supplied through the channels 111 and 112 to the bottom surface 100 of the nozzle portion and from dropping.

In addition, wettability of the liquid chamber channel 102, the auxiliary liquid chamber 103, the fluid resistance portion 104, the compression chamber 105, and the nozzle hole 107 with the composition matters also in the nozzle portion 109. Therefore, each portion to be in contact with the composition may be provided with a carbon film, a resin film, or the like in order to adjust the wettability of materials with the composition.

According to the above-described structure, a composition can be accurately discharged to an object to be treated. A droplet discharge method includes a so-called sequential method by which droplets are continuously discharged to form a continuous linear pattern and a so-called on-demand method by which droplets are discharged to be dot-shaped. Either of the methods may be used. In addition, a dispenser method may be used in the case of forming a continuous linear pattern.

Subsequently, the structure of a droplet discharge means in a droplet discharge apparatus, in which a plurality of nozzle holes is arranged, will be explained with reference to FIGS. 2A to 2C. Note that the same reference numeral is used to denote the same component as that in FIGS. 1A to 1C.

As in the droplet discharge means 101 shown in FIGS. 1A to 1C, a droplet discharge means 120 includes a plurality of auxiliary liquid chambers 103 connected to liquid chamber channels 102, and a plurality of nozzle portions 109 each having a fluid resistance portion 104, a compression chamber 105, a piezoelectric element 106, and a nozzle hole 107, which are connected to each other.

Figure 2A:
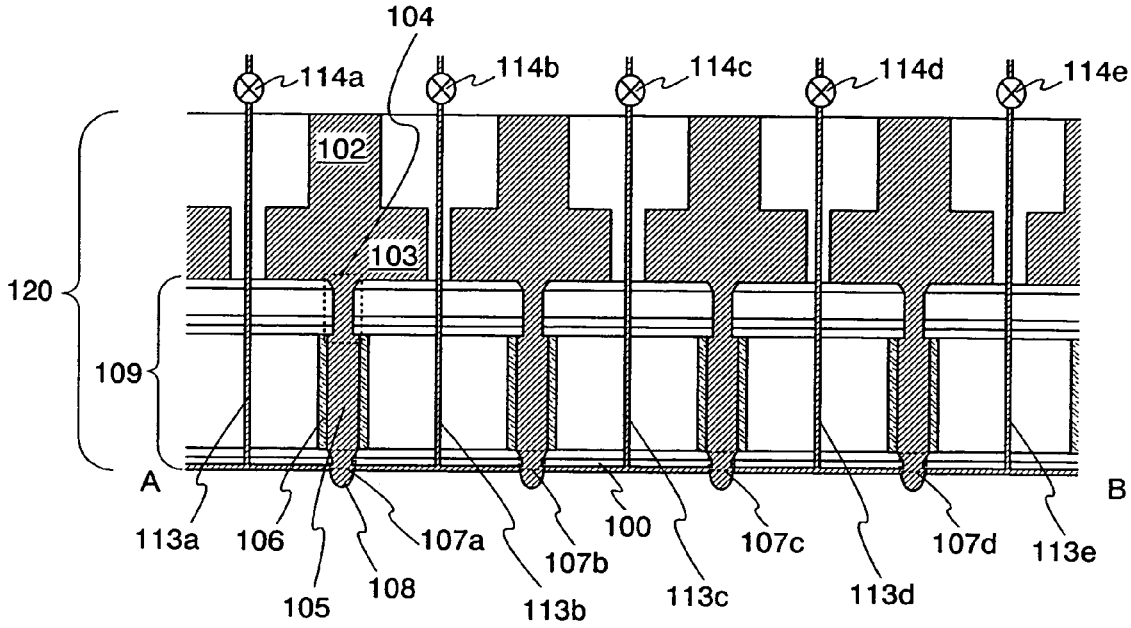
FIGS. 2A to 2C show a droplet discharge means provided with a plurality of nozzle holes.
Figure 2B:
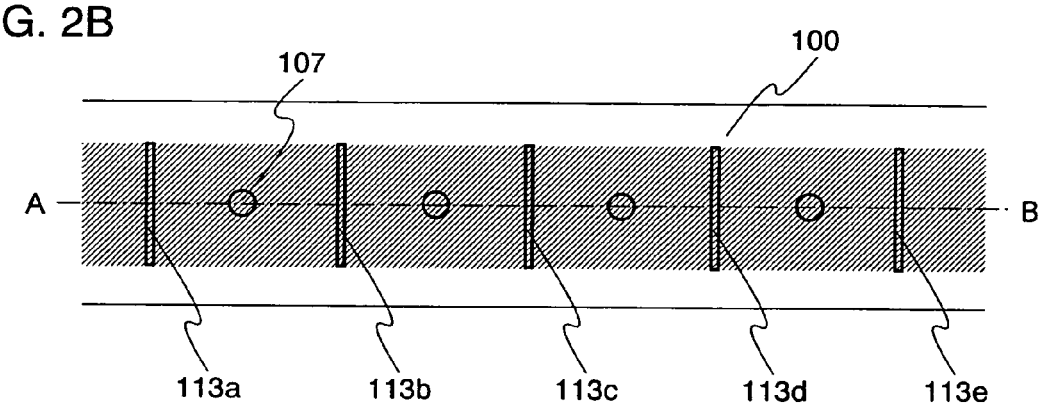
Figure 2C:
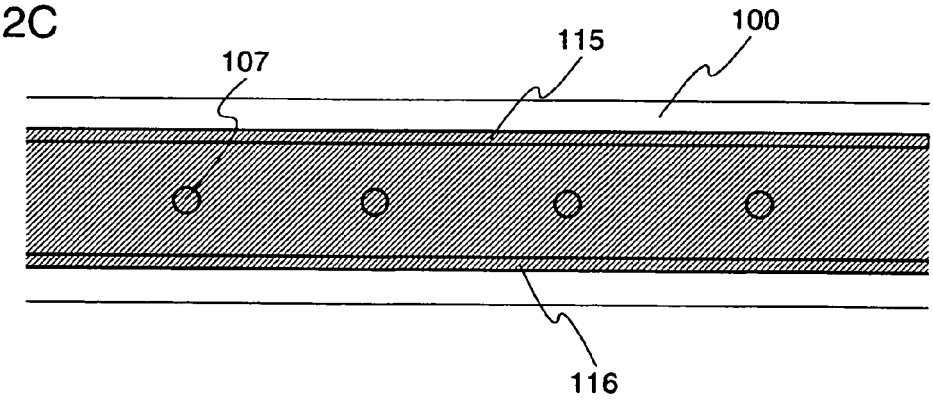

In FIGS. 2A to 2C, nozzle portions 109 are provided with channels 113*a* to 113*e*. Here, the channels 113*a* to 113*e* are provided between the adjacent nozzle holes 107*a* to 107*d*, and the nozzle holes 107*a* to 107*d* and a bottom surface 100 of the nozzle portion are covered with a composition supplied through the channels 113*a* to 113*e* (FIGS. 2A and 2B). A composition is supplied through the channels 113*a* to 113*e*; thus, a composition in the nozzle holes 107*a* to 107*d* can be prevented from drying. Note that the same composition as that discharged from the nozzle holes 107*a* to 107*d* is preferably used as that supplied to the bottom surface 100 of the nozzle portion through the channels 113*a* to 113*e*; alternatively, a solvent of the composition, a solution for preventing the composition from drying, or the like may be used.

The channels may have any shape. For example, the channels may be formed among a plurality of nozzle holes perpendicular to the sequence of nozzle holes (FIG. 2B), or channels 115 and 116 may be linearly formed parallel to the sequence of nozzle holes (FIG. 2C). Alternatively, they may be formed in circular shapes (including annular or ring-like shapes) around each nozzle hole as shown in FIG. 1C.

Note that a plurality of nozzle holes is arranged in a straight line in FIGS. 2A to 2C; however, the invention is not limited thereto. For example, nozzle holes may be arranged in zigzag, in other words, staggered so as to form triangles, or nozzle holes may be arranged one above the other.

Each channel 113*a* to 113*e* can be provided with a liquid sending means or a liquid return means as shown in FIGS. 1A to 1C. Here, end portions of the channels 113*a* to 113*e*, which are not connected to the bottom surface 100 of the nozzle portion, are provided with pumps 114*a* to 114*e* each having a liquid sending means or a liquid returning means; accordingly, the composition flow in the channels 113*a* to 113*e* can be controlled.

The composition may be supplied to the channels 113*a* to 113*e* by separately and externally providing a liquid chamber for supply or by connecting with the auxiliary liquid chamber 103.

The composition supplied through the channels 113*a* to 113*e* to the bottom surface 100 of the nozzle portion is required not to drop. Therefore, the bottom surface 100 of the nozzle portion is preferably put in a state of not repelling the composition (lyophilic state) in advance. In addition, the composition is controlled by a pump having a liquid sending means or the like so as to prevent the composition from being excessively supplied through the channels 113*a* to 113*e* to the bottom surface 100 of the nozzle portion and from dropping.

According to the above-described structure, the composition can be accurately discharged to an object to be treated. A droplet discharge method includes a so-called sequential method by which droplets are continuously discharged to form a continuous linear pattern and a so-called on-demand method by which droplets are discharged to be dot-shaped. Either of the methods may be used. In addition, a dispenser method may also be used in the case of forming a continuous linear pattern.

The case of discharging a composition by a so-called piezo method using a piezoelectric element is described in this embodiment mode. However, without limiting to this, a so-called thermal inkjet method, by which a heating element is made to generate heat and to produce bubbles, thereby extruding a composition, may also be used. In this case, the piezoelectric element 106 may be replaced by a heating element.

Embodiment Mode 2

In this embodiment mode, a droplet discharge apparatus different from that in Embodiment Mode 1 will be explained with reference to drawings. Note that the same reference numeral is used to denote the same component as that in Embodiment Mode 1 in the drawing shown in this embodiment mode.

First, a specific structure of a droplet discharge means in a droplet discharge apparatus of this embodiment mode will be explained with reference to FIG. 3A. A droplet discharge means 201 includes an auxiliary liquid chamber 103 connected to a liquid chamber channel 102; a nozzle portion 209 having a fluid resistance portion 104, a compression chamber 105, a piezoelectric element 106, and a nozzle hole 107; and channels 211 and 212 which are means for supplying a composition to the nozzle hole 107.

After a composition externally supplied into the droplet discharge means 201 passes through the liquid chamber channel 102 and is stored in the auxiliary liquid chamber 103, it moves to the nozzle portion 209 for discharging a composition. In the nozzle portion 209, the compression chamber 105 is filled with a moderate amount of compositions by the fluid resistance portion 104.

The piezoelectric element 106 which deforms by applying voltage is provided on a side wall of the compression chamber 105. As the piezoelectric element 106, a piezoelectric element having a piezoelectric effect of, for example, lead zirconate titanate (PZT) or the like can be used. By applying voltage to the piezoelectric element 106 arranged in a desired nozzle, the composition in the compression chamber 105 can be extruded and the compositions 108 can be externally discharged from the nozzle hole 107.

Figure 3A:
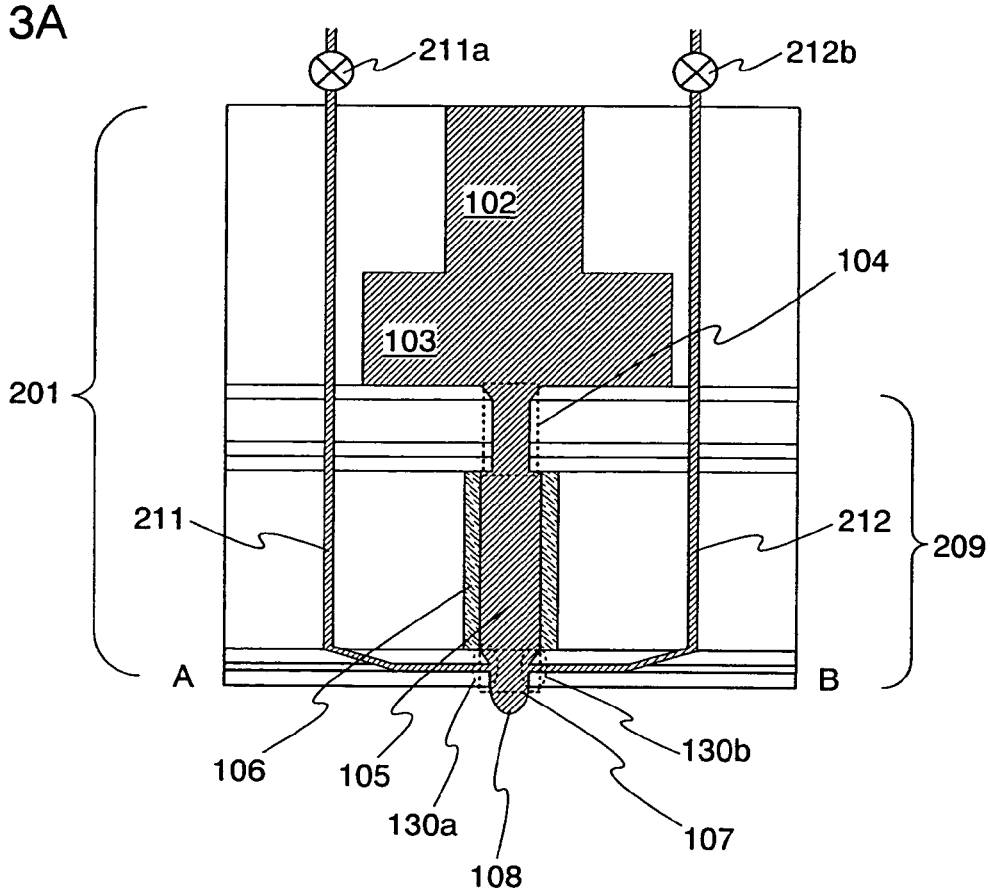
FIGS. 3A and 3B show a droplet discharge means.
Figure 3B:
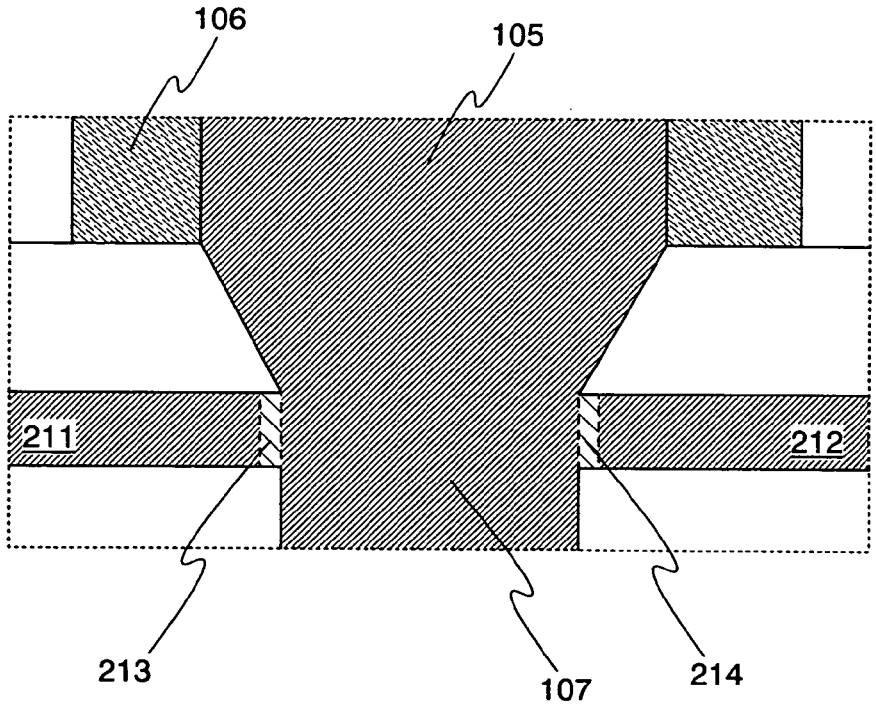

In the droplet discharge means 201 shown in FIGS. 3A and 3B, the channels 211 and 212, through which the composition can flow to the nozzle portion 209, are provided. The channels 211 and 212 are connected to the nozzle hole 107, and the composition is exchanged in a connection portion of the nozzle hole 107 and the channel 211 or 212. The composition existing in the nozzle hole 107 generally tends to be dried since the composition is exposed to air; however, the composition in the nozzle hole 107 can be replaced and can be prevented from drying by externally supplying a new composition directly to the nozzle hole 107. Here, side walls 130*a* and 130*b* of the nozzle hole 107 are provided with the channels 211 and 212, respectively.

The channels 211 and 212 may be provided with a means for sending and supplying the composition to the nozzle hole 107 (liquid sending means) or a means for suctioning and recovering the composition from the nozzle hole 107 (liquid return means). As the liquid sending means or the liquid return means of the composition, a pump or the like can be used as described in Embodiment Mode 1. The composition flow in the channels 211 and 212 and the nozzle hole 107 can be controlled by providing end portions of the channels 211 and 212 opposite to end portions connected to the nozzle hole 107 with pumps 211*a* and 212*b* having a liquid sending means or a liquid return means.

Note that both the pumps 211*a* and 212*b* provided for the channels 211 and 212 may have the liquid sending means or the liquid return means, or one of them may have the liquid sending means and the other may have the liquid return means. This can be appropriately selected by a practitioner. The composition flow can be selectively controlled by a combination of providing the pumps 211*a* and 212*b* with the liquid sending means or the liquid return means.

When one of the channels (for example, the channel 211) has the liquid sending means and supplies the composition to the nozzle hole 107, and the other (for example, the channel 212) has the liquid return means and suctions the composition from the nozzle hole 107, the composition in the channels 211 and 212 and the nozzle hole 107 can be controlled to flow in a particular direction. Since the composition flow in the nozzle hole 107 is generally irregular (in a turbulent state), a discharge direction does not become uniform at the time of discharge. However, the composition flow in the nozzle hole 107 can be made regular (for example, laminar) by exchanging the composition with the nozzle hole 107 using the channels 211 and 212. Accordingly, a discharge position or direction of the composition can be accurately controlled.

The connection portion of the channels 211 and 212 and the nozzle hole 107 may be provided with an openable and closable valve. The case will be explained with reference to FIG. 3B.

The composition is generally discharged by applying voltage to and deforming the piezoelectric element 106 provided on a side wall of the compression chamber 105 and extruding the composition from the nozzle hole 107. However, due to the channels 211 and 212 connected to the nozzle hole 107, it is feared that composition extruding force also affects the composition in the channels 211 and 212 at the time of discharge and the amount of composition to be discharged from the nozzle hole 107 or a discharge direction cannot be accurately controlled. Therefore, on-off valves 213 and 214, which adjust exchange of the composition between the nozzle hole 107 and the channels 211 and 212 by opening and closing, may be provided in the connection portion of the nozzle hole 107 and the channels 211 and 212 as shown in FIG. 3B.

When the composition is discharged from the nozzle hole 107, the on-off valves 213 and 214 are closed. When the composition is not discharged from the nozzle hole 107 (when the nozzle portion 209 is not used), the on-off valves are opened and can supply the composition through the channels 211 and 212 to the nozzle hole 107. Even when the channels connected to the nozzle hole are provided, the amount of composition or a discharge direction can be controlled by thus controlling the opening and closing of the on-off valves 213 and 214. The on-off valves 213 and 214 may be in any form that can block the connection portion of the nozzle hole 107 and the channels 211 and 212. A valve which opens and closes with a point fixed or a valve which opens and closes by sliding can be used.

The composition may be supplied to the channels 211 and 212 by separately and externally providing a liquid chamber for supply or by connecting the auxiliary liquid chamber 103 to the channels 211 and 212.

In addition, wettability of the liquid chamber channel 102, the auxiliary liquid chamber 103, the fluid resistance portion 104, the compression chamber 105, and the nozzle hole 107 with the composition matters in the nozzle portion 209. Therefore, each portion to be in contact with the composition may be provided with a carbon film, a resin film, or the like in order to adjust the wettability of materials with the composition.

According to the above-described means, the composition can be accurately discharged to an object to be treated. A droplet discharge method includes a so-called sequential method by which droplets are continuously discharged to form a continuous linear pattern and a so-called on-demand method by which droplets are discharged to be dot-shaped. Either of the methods may be used. In addition, a dispenser method may also be used in the case of forming a continuous linear pattern.

Subsequently, the structure of a droplet discharge means, in which a plurality of nozzle holes is arranged, according to the droplet discharge means shown in FIGS. 3A and 3B will be explained with reference to FIGS. 4A to 4C. Note that the same reference numeral is used to denote the same component as that shown in the above drawings.

Figure 4A:
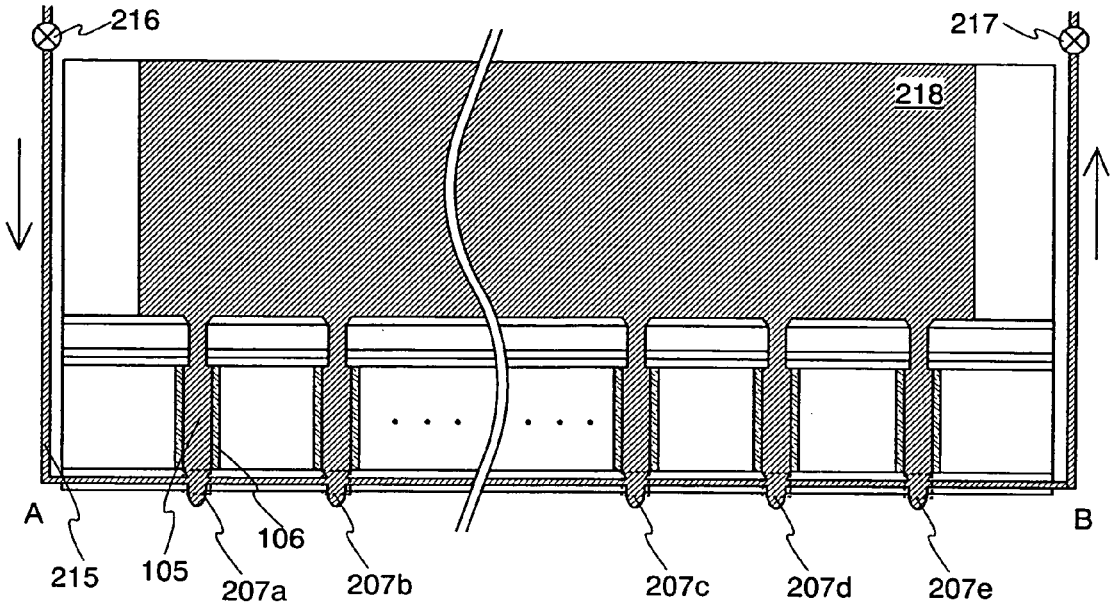
FIGS. 4A to 4C show a droplet discharge means provided with a plurality of nozzle holes.
Figure 4B:
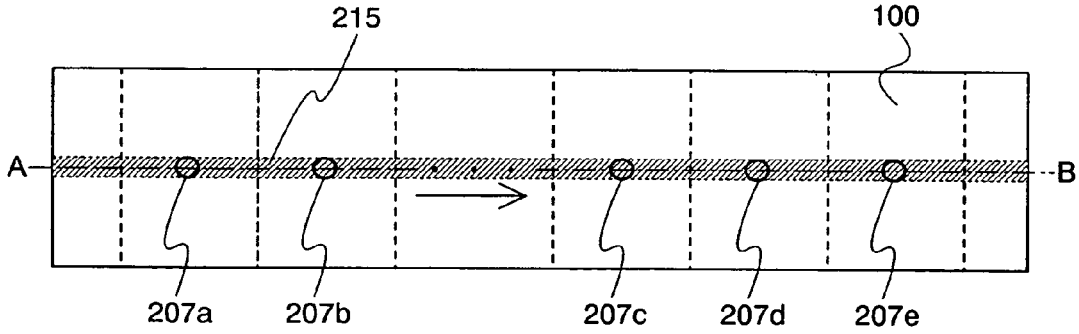
Figure 4C:
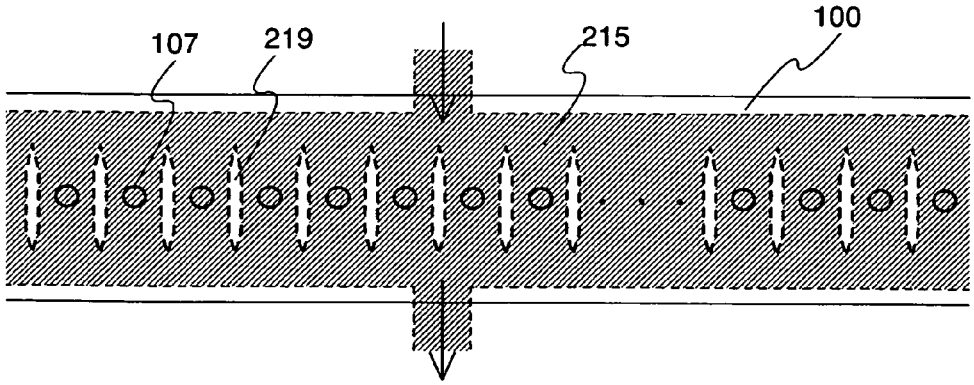

In FIGS. 4A to 4C, a shared liquid chamber 218 is provided and connected to each of a plurality of compression chambers 105 in a nozzle portion. A channel 215 connected to a plurality of nozzle holes 207*a* to 207*e* is also provided. Each end portion of the channel 215 is provided with a liquid sending means 216 which sends out a composition and a liquid return means 217 which suctions the composition. In the channel 215, the composition is controlled to flow from the nozzle hole 107*a* toward the nozzle hole 107*e*. Without limiting to this, both of the end portions of the channel 215 may be provided with liquid sending means or liquid return means as described above.

The channel 215 may have any shape or arrangement as long as the composition can be supplied to the nozzle holes 207*a* to 207*e*. For example, as shown in FIGS. 4A and 4B, the channel 215 can be provided to connect adjacent nozzle holes (for example, the nozzle holes 107*a* and 107*b*) to each other, and can be provided so that the composition flows from one end portion of the channel 215 to the other end portion of the channel 215 through the nozzle holes 107*a* to 107*e*.

Alternatively, as shown in FIG. 4C, the channel 215 may be formed to be shared by a plurality of nozzle holes, and the composition may flow perpendicular to the sequence of the nozzle holes. In this case, a partition 219 is preferably provided between adjacent nozzle holes for nozzle portion reinforcement. In addition, a flow direction of the composition can be aligned by providing the partition 219.

According to the above-described means, the composition can be accurately discharged to an object to be treated. A droplet discharge method includes a so-called sequential method by which droplets are continuously discharged to form a continuous linear pattern and a so-called on-demand method by which droplets are discharged to be dot-shaped. Either of the methods may be used. In addition, a dispenser method may also be used in the case of forming a continuous linear pattern.

The case of discharging a composition by a so-called piezo method using a piezoelectric element is described in this embodiment mode. However, without limiting to this, a so-called thermal inkjet method, by which a heating element is made to generate heat and to produce bubbles, thereby extruding a composition, may also be used. In this case, the piezoelectric element 106 may be replaced by a heating element.

Note that this embodiment mode can be freely combined with the above-described embodiment mode.

Embodiment Mode 3

In this embodiment mode, the structure of a droplet discharge apparatus, which is different from that in the above-described embodiment mode, will be explained with reference to drawings. Note that the same reference numeral is used to denote the same component as that in the above-described embodiment mode.

In this embodiment mode, the structure of a droplet discharge means 301, in which a circulation channel 321 connected to a compression chamber 305 is provided, will be explained with reference to FIGS. 5A and 5B.

The droplet discharge means 301 includes an auxiliary liquid chamber 103 connected to a liquid chamber channel 102, and a nozzle portion 309 having a fluid resistance portion 104, a compression chamber 305, piezoelectric elements 306*a* to 306*d*, the circulation channel 321, and a nozzle hole 107.

After a composition externally supplied into the droplet discharge means 301 passes through the liquid chamber channel 102 and is stored in the auxiliary liquid chamber 103, the composition moves to the nozzle portion 309 for discharging the composition. In the nozzle portion 309, the compression chamber 305 is filled with a moderate amount of composition by the fluid resistance portion 104.

The piezoelectric elements 306*a* and 306*b* which is deformed by applying voltage are provided on a side wall of the compression chamber 305. Further, in this embodiment mode, the circulation channel 321 connected to a side wall of the compression chamber 305 is provided, and the piezoelectric elements 306*c* and 306*d* are provided on a side wall of the circulation channel 321.

The piezoelectric elements 306*a* to 306*d* provided for the compression chamber 305 and the circulation channel 321 can be individually deformed by applying voltage. As the piezoelectric element, a piezoelectric element having a piezoelectric effect of, for example, lead zirconate titanate (PZT) or the like can be used. By selectively applying voltage to the piezoelectric elements 306*a* to 306*d* arranged in a desired nozzle, the composition in the compression chamber 305 can be extruded and the composition 108 can be externally discharged.

In this embodiment mode, the composition in the compression chamber 305 and the nozzle hole 107 is made to flow and the composition in the nozzle hole 107 is replaced by using the circulation channel 321 provided for the compression chamber 305. Thus, the composition can be prevented from drying. A composition flow in the compression chamber 305 and the nozzle hole 107 will be explained below.

Figure 5A:
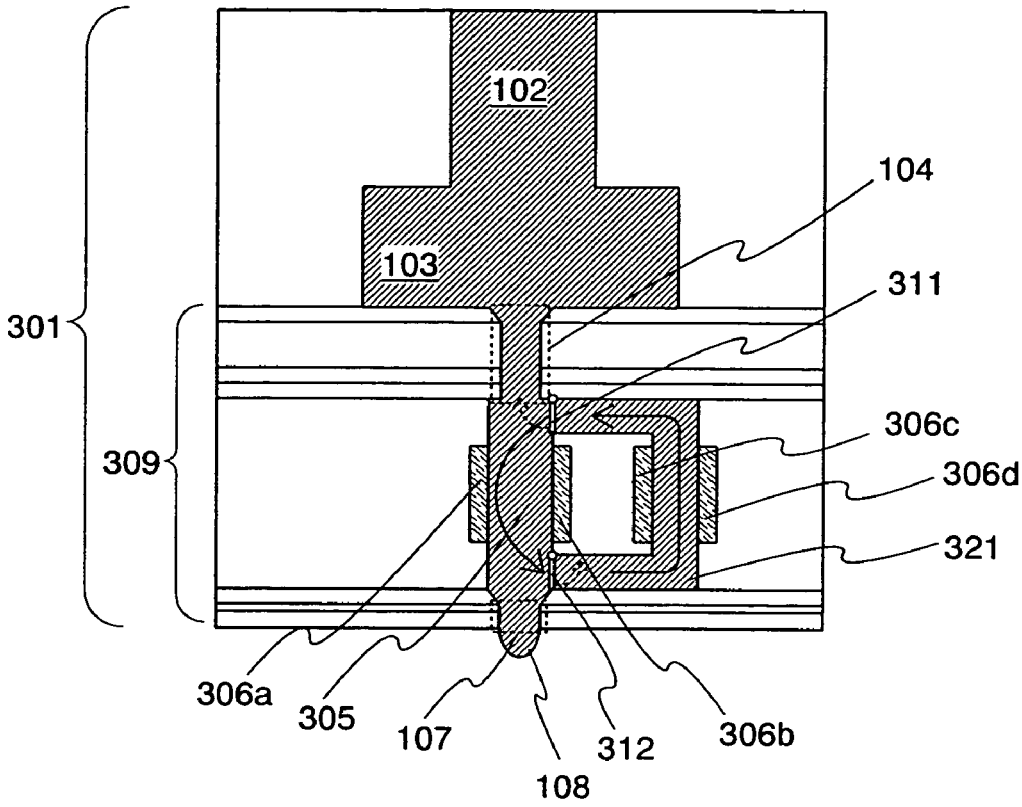
FIGS. 5A and 5B show a droplet discharge means.

As shown in FIG. 5A, openable and closable on-off valves 311 and 312 are provided in a connection portion of the compression chamber 305 and the circulation channel 321. The composition flows in an arrow (solid line) direction due to the piezoelectric elements 305*a* to 305*d* and the on-off valves 311 and 312. In FIGS. 5A and 5B, each on-off valve 311 and 312 can be opened and closed only in one direction, and has a function of preventing a back flow of the composition. Here, the on-off valve 311 is provided to be openable and closable only to the left side on the paper, and the on-off valve 312 is provided to be openable and closable only to the right side on the paper. Then, the composition is made to flow in a solid line arrow direction by selectively applying voltage to and deforming the piezoelectric elements 306*a* to 306*d*.

Specifically, the composition is moved to open the on-off valve 312 by expanding the piezoelectric elements 306*c* and 306*d* when the piezoelectric elements 306*a* and 306*b* shrink. Then, the composition in the compression chamber 305 and the nozzle hole 107 can be made to flow without discharging the composition from the nozzle hole 107. At the same time, since the on-off valve 311 is opened and the composition is moved, a new composition is moved to the nozzle hole 107 and the composition in the nozzle hole 107 is replaced thereby. Accordingly, the composition in the nozzle hole 107 can be prevented from drying. When the composition in the circulation channel 321, the compression chamber 305, and the nozzle hole 107 can be made to flow by shrinking or expanding only the piezoelectric elements 306*c* and 306*d*, the piezoelectric elements 306*a* and 306*b* may not be used.

Figure 5B:
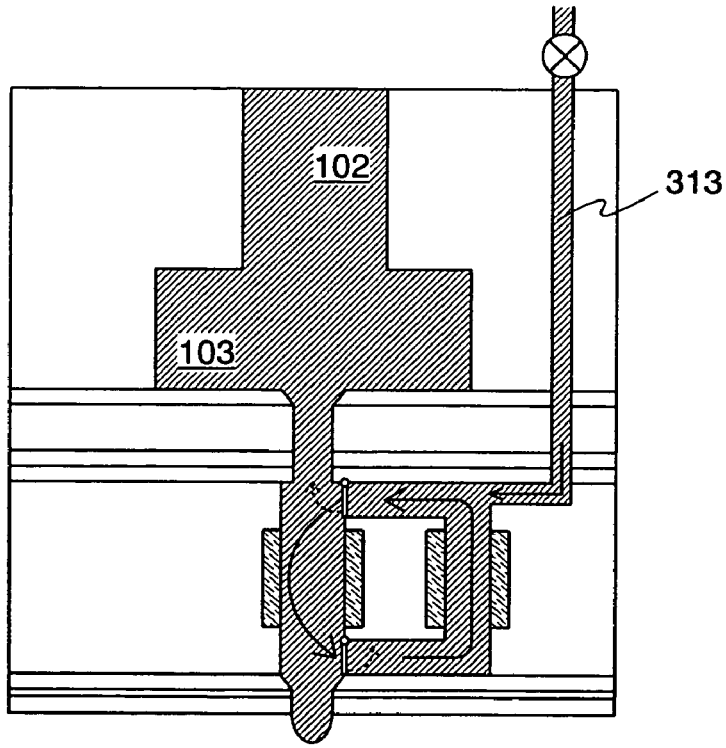

As shown in FIG. 5B, a channel 313 which can externally supply the composition to the circulation channel 321 may be provided. Even in the case of circulating the composition in the nozzle hole 107, there is a general problem of an increase in the composition viscosity due to solvent evaporation of the composition over time. Viscosity increase or drying of the composition in the nozzle hole 107 can be prevented by providing the channel 313 and supplying a new composition to the circulation channel 321.

According to the above-described means, the composition in the nozzle hole can be prevented from drying, and the composition can be efficiently discharged to an object to be treated. A droplet discharge method includes a so-called sequential method by which droplets are continuously discharged to form a continuous linear pattern and a so-called on-demand method by which droplets are discharged to be dot-shaped. Either of the methods may be used. In addition, a dispenser method may also be used in the case of forming a continuous linear pattern.

Note that this embodiment mode can be freely combined with any of the above-described embodiment modes.

Embodiment Mode 4

In this embodiment mode, a structure example of a linear droplet discharge apparatus with the droplet discharge means described in Embodiment Modes 1 to 3 will be explained with reference to drawings.

Figure 6A:
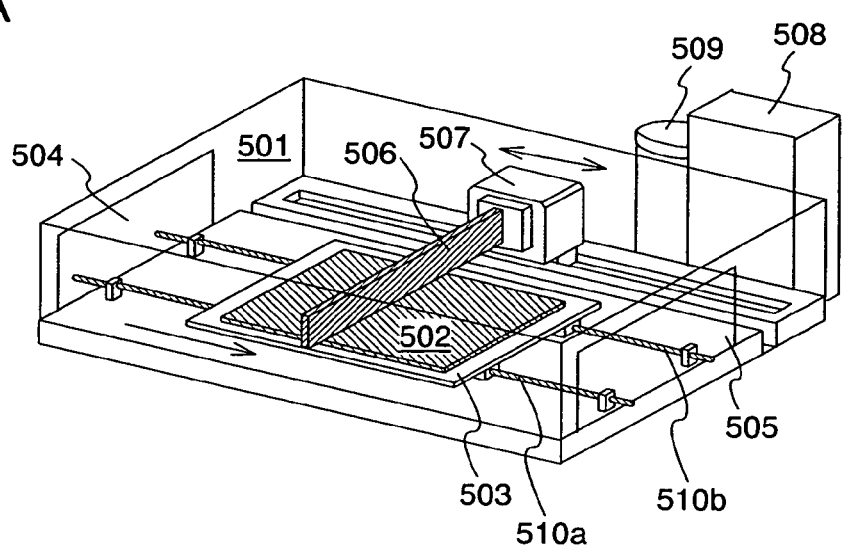
FIGS. 6A to 6C show a droplet discharge apparatus.

A linear droplet discharge apparatus shown in FIG. 6A includes a droplet discharge means 506 and forms a desired composition pattern over a substrate 502 by discharging a composition therefrom. In this linear droplet discharge apparatus, a substrate such as a resin substrate typified by a plastic substrate, a semiconductor wafer typified by silicon, as well as a glass substrate having a desired size, can be used as the substrate 502.

In FIG. 6A, the substrate 502 is carried from a loading gate 504 into a chassis 501, and the substrate is carried out from an unloading gate 505 after composition discharge. In the chassis 501, the substrate 502 is mounted on a transport stage 503, and the transport stage 503 moves along rails 510*a* and 510*b* which connects the loading gate 504 and the unloading gate 505.

A support portion 507 supports the droplet discharge means 506 which discharges the composition, and moves parallel to the transport stage 503. When the substrate 502 is carried into the chassis 501, the support portion 507 is moved to a predetermined position at the same time. Discharging can be efficiently performed by moving the droplet discharge means 506 to an initial position at the time of carrying the substrate in or out.

Droplet discharging starts when the substrate 502 reaches a predetermined position where the droplet discharge means 506 waits by the movement of the transport stage 503. Droplet discharging is achieved by a combination of relative movement of the support portion 507 and the substrate 502 and droplet discharging from the droplet discharge means 506 supported by the support portion 507. A desired droplet pattern can be drawn over the substrate 502 by adjusting a movement speed of the substrate 502 and the support portion 507 and a cycle of composition discharge from the droplet discharge means 506. Since droplet discharging particularly requires high accuracy, only the support portion 507 having good controllability is preferably sequentially moved while the transport stage is stopped from moving at the time of droplet discharge. The droplet discharge means 506 can be moved back and forth in one direction.

A raw material solution is supplied from a droplet supplying portion 509 provided outside of the chassis 501 into the chassis 509 and further to a liquid chamber in the droplet discharge means 506 through the support portion 507. The raw material solution supply is controlled by a control means 508 provided outside of the chassis 501, but it may be controlled by a control means incorporated in the support portion 507 in the chassis.

The movement of the transport stage and the support portion 507 is similarly controlled by the control means 508 provided outside of the chassis 501.

Figure 6B:
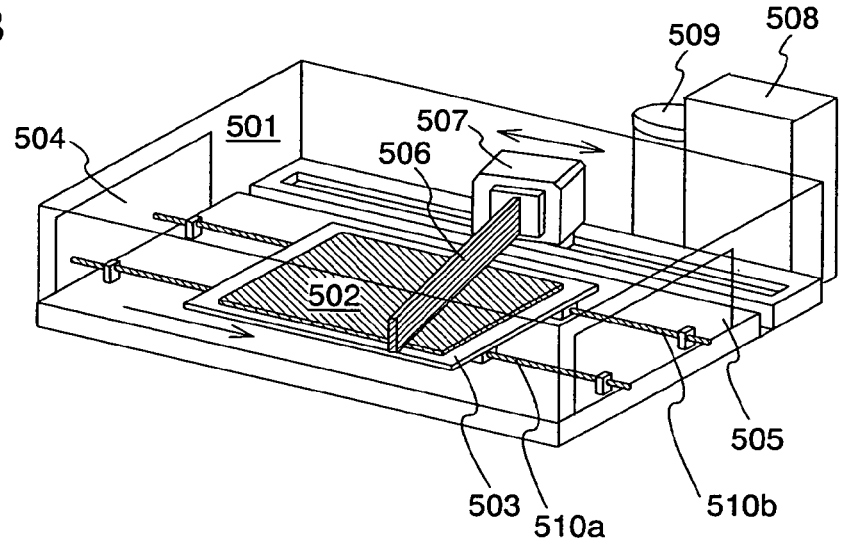
Figure 6C:
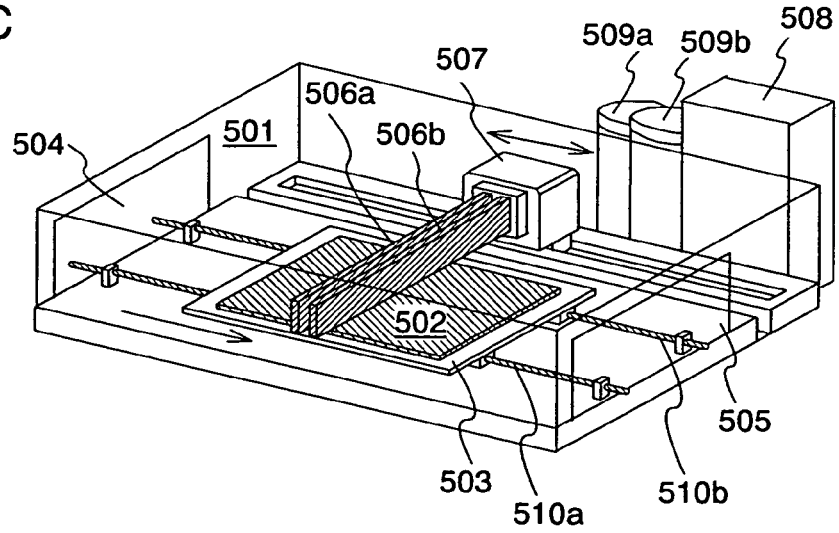

The droplet discharge apparatus shown in FIGS. 6A to 6C may be further provided with a sensor for alignment with the substrate or the pattern over the substrate, a means for introducing a gas into the chassis, a means for exhausting the chassis, a means for heat-treating the substrate, a means for irradiating the substrate with light, a means for measuring various physical values such as temperature or pressure, or the like, if necessary. These means can also be collectively controlled by the control means 508 provided outside of the chassis 501. When the control means 508 is further connected to a production control system or the like via a LAN cable, a wireless LAN, an optical fiber, or the like, a process can be externally collectively controlled, which leads to an improvement in productivity.

Subsequently, a linear droplet discharge apparatus shown in FIG. 6B, which is an improvement on the linear droplet discharge apparatus shown in FIG. 6A, will be explained. This apparatus is designed so that the droplet discharge means 506 is at an angle with the substrate 502 by providing the support portion 507 with a rotating means and rotating by an arbitrary angle θ. The angle θ may be any angle; however, in consideration of an apparatus size as a whole, it is preferably in the range of 0° to 45° toward a moving direction of the substrate 502. Providing the support portion 507 with a rotating means makes it possible to draw a composition pattern at a narrower pitch than that of the nozzle hole provided for the droplet discharge means 506.

FIG. 6C shows a linear droplet discharge apparatus in which two droplet discharge means 506 of the linear droplet discharge apparatus shown in FIG. 6A are arranged. In this apparatus, compositions having different materials can be collectively discharged by single movement. In other words, continuous pattern formation can be performed, in which while a pattern is formed by discharging a raw material solution A from a first droplet discharge means 506*a*, another pattern is formed by discharging a raw material solution B from a second droplet discharge means 506*b* with a small time difference. Reference numerals 509*a* and 509*b* denote raw material solution supplying portions, which store and supply the raw material solution A and the raw material solution B used in each droplet discharge means. With the use of this structure, processes can be simplified and efficiency can be increased significantly.

Figure 7A:
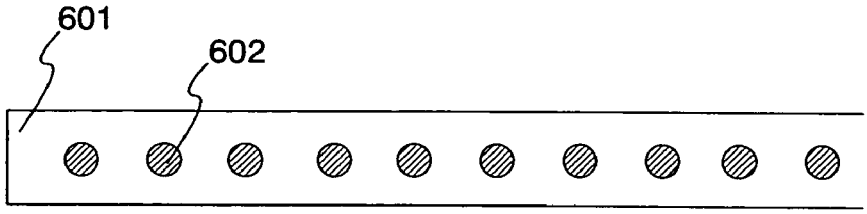
FIGS. 7A to 7C show the sequence of nozzle holes in a droplet discharge apparatus.
Figure 7B:
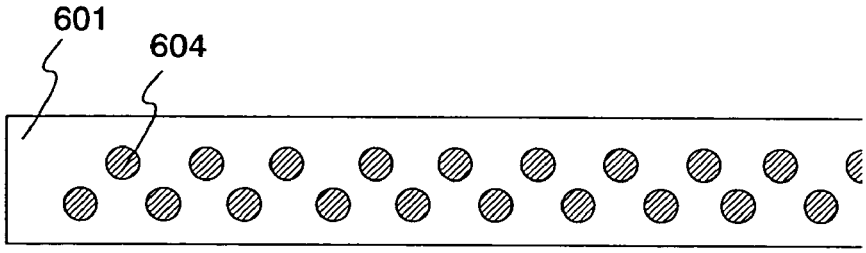
Figure 7C:
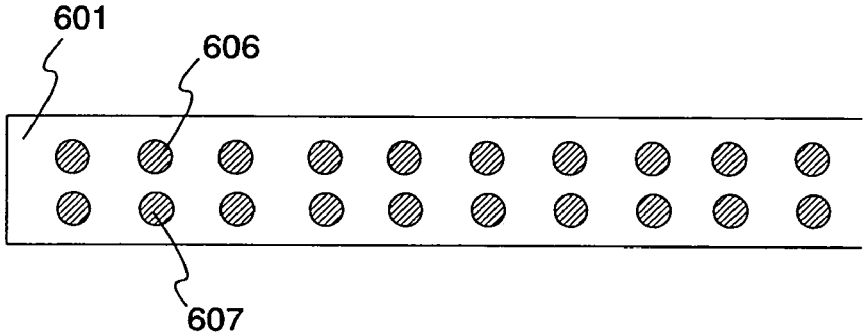

FIGS. 7A to 7C schematically show bottoms of the droplet discharge means shown in FIGS. 6A to 6C.

FIG. 7A shows nozzle holes 602 arranged in a linear shape on a bottom surface 601 of the nozzle portion. On the other hand, FIG. 7B shows nozzle holes 604 on a bottom surface 601 of the nozzle portion, arranged in two lines and arranged in zigzag in which one line is misaligned to the other by a half pitch so that the nozzle holes form triangles. FIG. 7C shows nozzle holes arranged in two lines without misaligning the pitch of nozzle holes.

According to the arrangement in FIG. 7C, by discharging a similar composition to a similar position with a time difference after discharging droplets from a nozzle hole 606 in a first line, the same droplets can be further laminated to be thick before the previously discharged composition over the substrate is dried or solidified.

Note that this embodiment mode can be freely combined with any of the above-described embodiment modes.

Embodiment Mode 5

In this embodiment mode, a droplet discharge apparatus, which is different from the above-described structures, will be explained with reference to FIGS. 8A and 8B. In the structure shown in FIGS. 8A and 8B and described below, the same reference numeral is commonly used to denote the same component in the above-described embodiment mode.

Figure 8A:
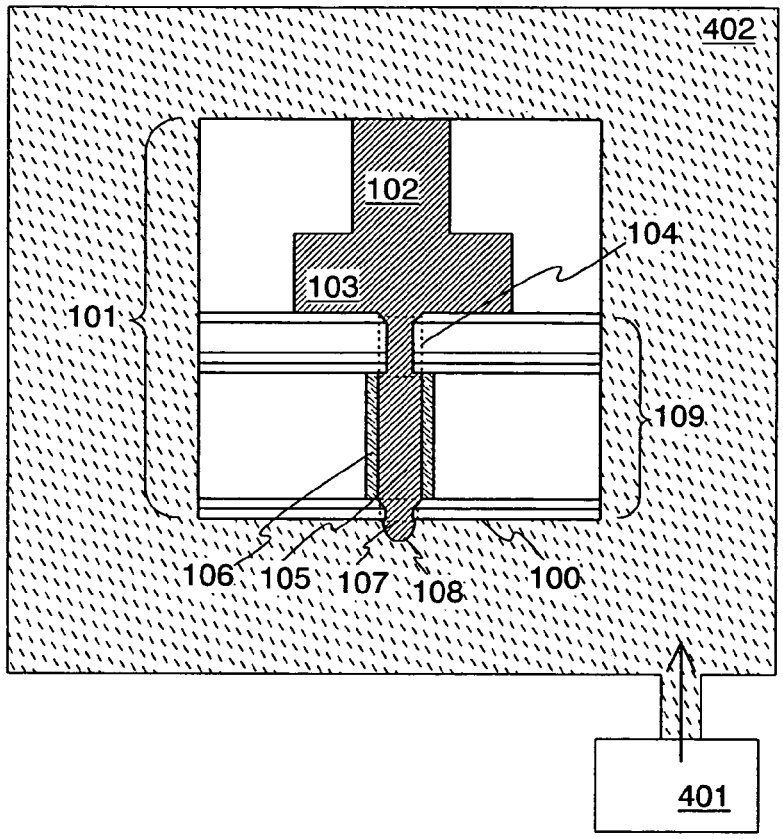
FIGS. 8A and 8B show a droplet discharge means.

As shown in FIG. 8A, in a droplet discharge apparatus according to this embodiment mode, at least the vicinity of a nozzle hole is placed in space filled with vapor of a solvent for a composition to be discharged. Therefore, a droplet discharge means 101 is provided in a closed space 402 which is shut off from the outside world, and the closed space 402 is filled with solvent vapor. In other words, the droplet discharge apparatus itself has a chamber structure with the closed space 402, and solvent vapor is supplied thereinto using a vapor supplying means 401. Thus, a composition in a nozzle hole 107 is kept constantly exposed to solvent vapor by placing the droplet discharge apparatus itself in space filled with vapor of a solvent for a composition to be discharged. Accordingly, the composition can be prevented from drying.

Figure 8B:
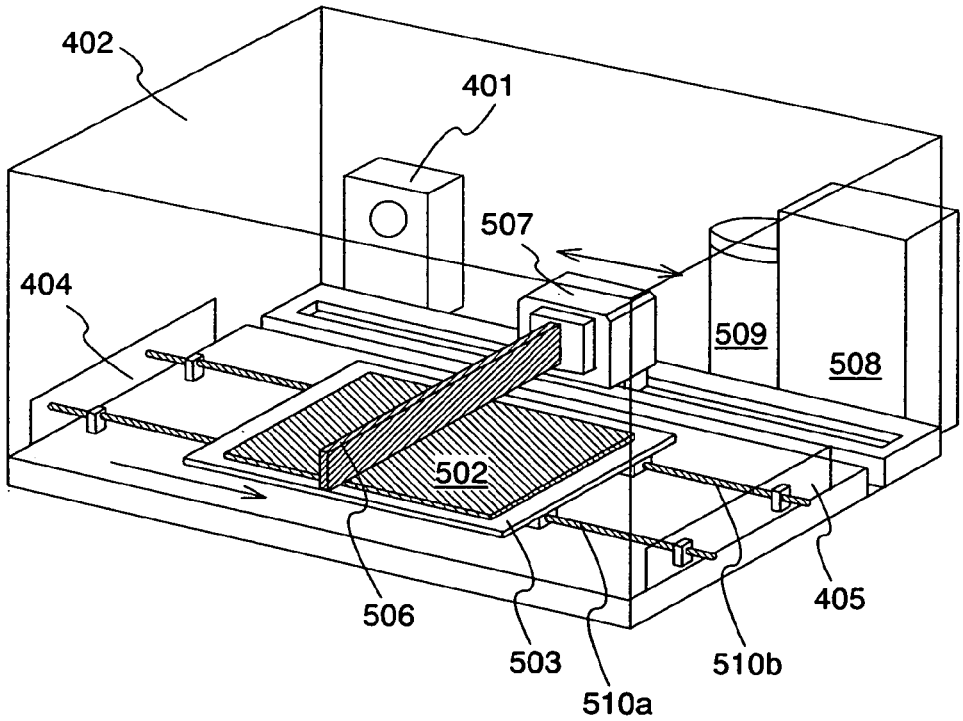

FIG. 8B shows an overall schematic view of a linear droplet discharge apparatus. The droplet discharge apparatus forms a desired composition pattern over a substrate 502 by discharging a composition using a droplet discharge means 506. The substrate 502 is carried from an openable and closable loading gate 404 into a closed space 402, and the substrate is carried out from an openable and closable unloading gate 405 after composition discharge. The substrate 502 is quickly carried in and out so that outside air does not enter.

Note that the closed space 402 is filled with vapor of a solvent for a composition by using the vapor supplying means 401. In the closed space 402, the substrate 502 is mounted on a transport stage 503, and the transport stage 503 moves along rails 510*a* and 510*b* which connect the loading gate 504 and the unloading gate 505. The droplet discharge means can have the structure described in the above embodiment mode.

According to the above-described structure, a composition to be discharged can be prevented from drying and solidifying in a droplet discharge apparatus. Note that this embodiment mode can be freely combined with any of the above-described embodiment modes.

Embodiment Mode 6

In this embodiment mode, a structure, in which a composition in a nozzle hole is prevented from drying by vibrating a droplet discharge apparatus, will be explained with reference to FIGS. 14A and 14B. Note that the same reference numeral is used to denote the same component as that in the above-described embodiment mode.

Figure 14A:
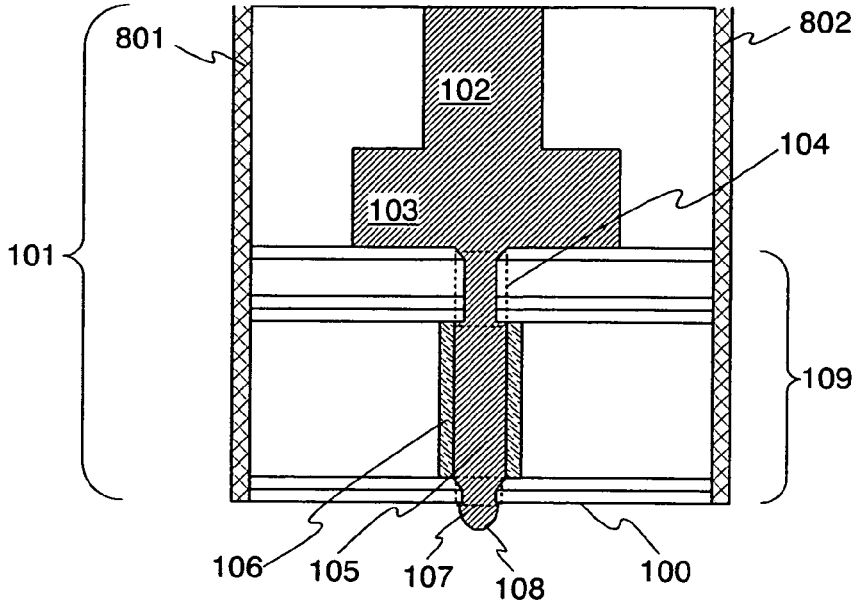
FIGS. 14A and 14B show a droplet discharge apparatus.

A droplet discharge apparatus described in this embodiment mode is provided with vibrating means 801 and 802 which can vibrate a whole droplet discharge means 101 (FIG. 14A). In this embodiment mode, a composition in an auxiliary liquid chamber 103, a fluid resistance portion 104, a compression chamber 105, and a nozzle hole 107 is vibrated by applying high frequency pulse voltage to and vibrating a piezoelectric element 106 in a nozzle portion 109 not discharging the composition and by vibrating the whole droplet discharge means 101 by the vibrating means 801 and 802. Accordingly, a composition flow is formed in the droplet discharge means 101, and the composition in the nozzle hole 107 can be prevented from drying.

Although there has been a method for forming a composition flow by applying high frequency pulse voltage to the piezoelectric element 106 and vibrating the composition, the composition cannot be made to flow sufficiently only by the vibration of the piezoelectric element 106. This is because only certain degree of vibration can be generated since the composition might come out of the nozzle hole in the case of powerfully vibrating the piezoelectric element and only the composition in the vicinity of the piezoelectric element (here, the composition in the compression chamber 105) is made to flow. Therefore, it is feared that defective discharge is caused when the viscosity of the composition in the nozzle hole is increased because composition flow is insufficient and solvent drying proceeds.

On the other hand, in this embodiment mode, the composition can be made to flow sufficiently by vibrating the whole droplet discharge means 101 with the vibrating means 801 and 802 in addition to the vibration of the piezoelectric element 106. Accordingly, a new composition can be constantly supplied in the nozzle hole 107; thus, the composition can be prevented from drying more surely than in a conventional method. Note that the piezoelectric element 106 may not be vibrated when the composition can be made to flow by the vibrating means 801 and 802.

Figure 14B:
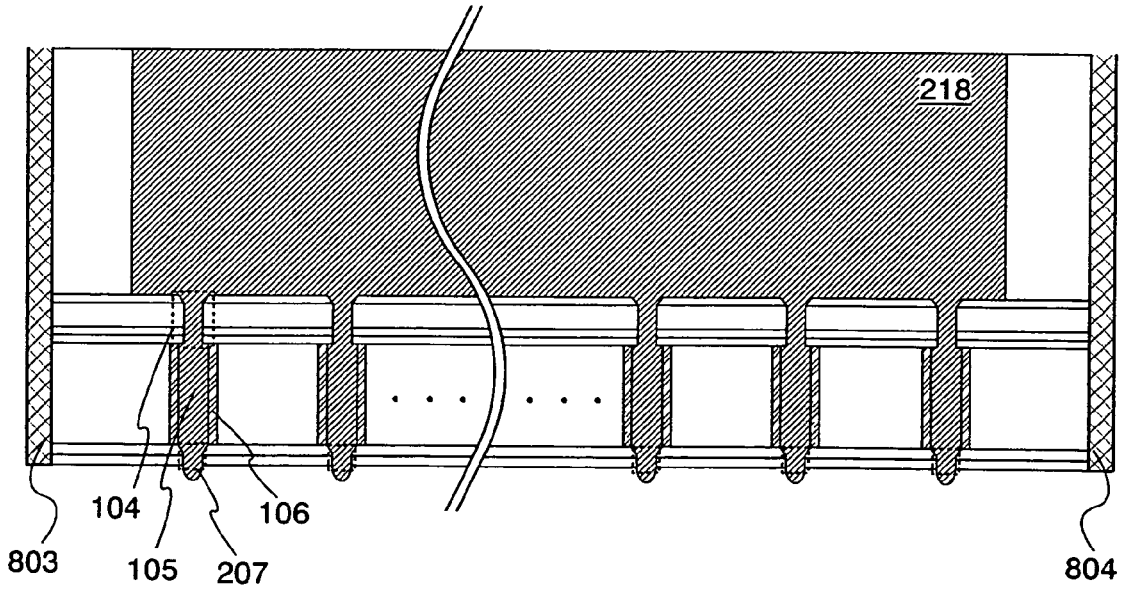

In the case of having a plurality of nozzle holes, a composition flow can be similarly formed by vibrating a piezoelectric element 106 and vibrating means 803 and 804 (FIG. 14B). In this case, the composition flows in a nozzle hole 207, a compression chamber 105, a fluid resistance portion 104, and a shared liquid chamber 218 connected to the fluid resistance portion 104. Even in the case where a solvent for the composition in the nozzle hole 207 is dried, defective discharge can be prevented since the composition is constantly replaced. The structures shown in FIGS. 14A and 14B may be provided with a channel as described in the above embodiment mode. In this case, the composition can be further prevented from drying.

Note that this embodiment mode can be freely combined with any of the above-described embodiment modes.

Embodiment Mode 7

In this embodiment mode, one structure example of a droplet discharge apparatus having the droplet discharge means described in the above embodiment mode, which is different from that shown in FIGS. 6A to 6C, will be explained with reference to the drawings.

Figure 9:
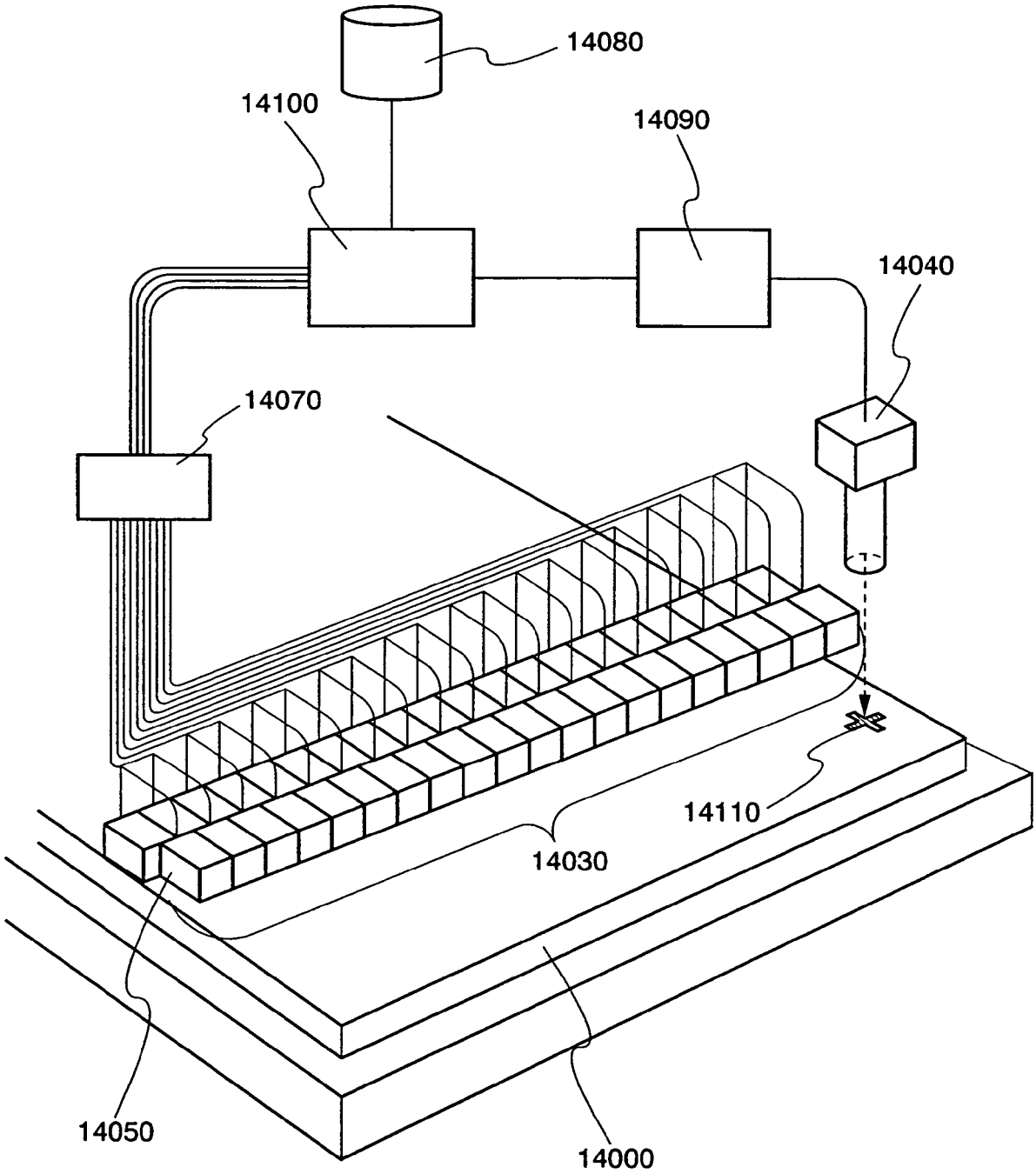
FIG. 9 shows a droplet discharge apparatus.

In this embodiment mode, FIG. 9 shows one form of a droplet discharge apparatus used to form a pattern such as a wiring. Each head 14050 of a droplet discharge means 14030 is connected to a control means 14070, and that is controlled by a computer 14100, so that a preprogrammed pattern can be drawn.

A position of drawing may be determined based on, for example, a marker 14110 formed over a substrate 14000. Alternatively, a reference point can be fixed based on an edge of the substrate 14000. The reference point is detected by an imaging means 14040 such as a CCD and converted into a digital signal by an image processing means 14090. Then, the digital signal is recognized by the computer 14100, and a control signal is generated and is transmitted to the control means 14070. Naturally, information on a pattern to be formed over the substrate 14000 is stored in a storage medium 14080, and the control signal is transmitted to the control means 14070 based on the information, so that each head 14050 of the droplet discharge means 14030 can be independently controlled.

When an object to be treated is large, discharge may be performed by moving the head 14050 in X-axis and Y-axis directions. This is extremely effective in the discharge to a large-size substrate wider than the head 14050 for discharging droplets. In addition, the apparatus can be miniaturized.

Note that the droplet discharge apparatus having a plurality of heads 14050 is described here, but the invention is not limited to this form. Discharge may be performed by moving one head in X-axis and Y-axis directions. In this case, the apparatus can be further reduced in size and weight.

In addition, plural kinds of materials can be simultaneously discharged by filling each of the plurality of heads 14050 with a different material. Further, wirings or the like having various line widths can be simultaneously formed depending on uses by separately setting each nozzle diameter of the plurality of heads 14050.

Note that this embodiment mode can be freely combined with any of the above-described embodiment modes.

Embodiment Mode 8

In this embodiment mode, a method for manufacturing a display device using the droplet discharge apparatus described in the above embodiment mode will be explained with reference to drawings.

Figure 10A:
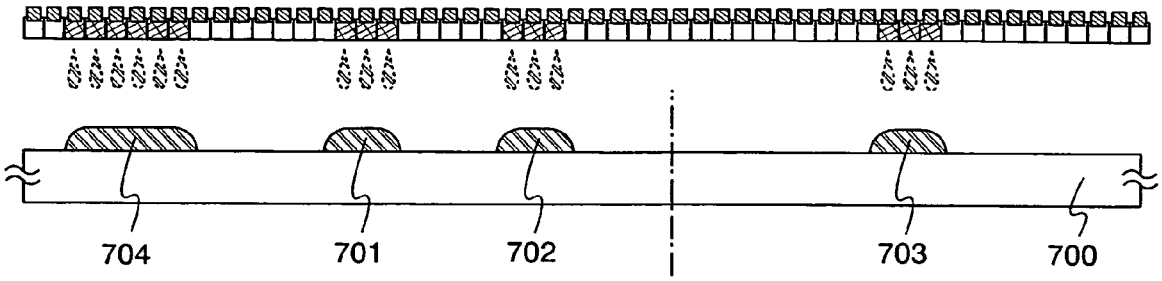
FIGS. 10A to 10D show a method for manufacturing a display device with the use of a droplet discharge apparatus.

First, a substrate 700 to be provided with a TFT and a light emitting element is prepared as shown in FIG. 10A. Specifically, a glass substrate of bariumborosilicate glass, aluminoborosilicate glass, or the like, a quartz substrate, a ceramic substrate, or the like can be used as the substrate 700. Further, a metal substrate including a stainless steel substrate or a semiconductor substrate provided with an insulating film on its surface may also be used. Although a substrate made from a synthetic resin having flexibility, such as plastics, generally tends to have a lower heat-resistance temperature than the above-described substrate, it can be used as the substrate 700 as long as it can withstand the process temperature in the manufacturing step. The surface of the substrate 700 may be planarized by polishing such as a CMP method.

Pretreatment is performed on the surface of the substrate 700 to improve adhesion with a conductive film or an insulating film to be formed by a droplet discharge method. As a method for improving adhesion, for example, a method in which metal or a metal compound which can improve adhesion with a conductive film or an insulating film by catalysis is attached to the surface of the substrate 700, a method in which an organic insulating film, metal, or a metal compound having good adhesion with a conductive film or an insulating film to be formed is attached to the surface of the substrate 700, a method in which surface modification is performed by performing plasma treatment on the surface of the substrate 700 under atmospheric pressure or reduced pressure, or the like can be used. As the metal having good adhesion with the conductive film or the insulating film, Sc, Ti, V, Cr, Mn, Fe, Co, Ni, Cu, Zn, or the like which is a 3d transition element as well as titanium, titanium oxide, or the like can be used. As the metal compound, oxide, nitride, oxynitride, or the like of the above-described metal can be used. As the organic insulating film, polyimide, an insulating film having a Si—O—Si bond formed by using a siloxane material as a starting material (hereinafter referred to as a siloxane insulating film), or the like can be used. Siloxane includes a skeleton formed from a bond of silicon (Si) and oxygen (O). An organic group containing at least hydrogen (for example, an alkyl group or aromatic hydrocarbon) or a fluoro group may be used for a substituent, or an organic group containing at least hydrogen and a fluoro group may be used for substituents.

In the case where metal or a metal compound to be attached to the substrate 700 has conductivity, sheet resistance thereof is controlled so as not to prevent normal operation of a semiconductor element. Specifically, an average thickness of metal or a metal compound having conductivity may be controlled to be, for example, 1 to 10 nm, or the metal or metal compound may be partially or entirely insulated by oxidation. Alternatively, the attached metal or metal compound may be selectively removed by etching except in a region of which adhesion is to be improved. Further alternatively, the metal or metal compound may be selectively attached only to a specific region by a droplet discharge method, a printing method, a sol-gel method, or the like, instead of entirely attaching the metal or metal compound to the substrate in advance. Note that the metal or metal compound need not be a completely continuous film on the surface of the substrate 700, and it may be dispersed to some extent.

In this embodiment mode, a photocatalyst such as ZnO or $TiO_2$ which can improve adhesion by photocatalysis is attached to the surface of the substrate 700. Specifically, ZnO or $TiO_2$ is dispersed in a solvent and spread over the surface of the substrate 700, or a compound of Zn or a compound of Ti is attached to the surface of the substrate 700. Thereafter, oxidation or sol-gel process is performed; consequently, ZnO or $TiO_2$ can be attached to the surface of the substrate 700.

Subsequently, gate electrodes 701 to 703 and a wiring 704 are formed on the surface of the substrate 700 on which the pretreatment is performed to improve adhesion, by using the droplet discharge apparatus having the droplet discharge means described in the above embodiment mode. Specifically, a conductive material including one or more of metal such as Ag, Au, Cu, or Pd or a metal compound thereof is used for the gate electrodes 701 to 703 and the wiring 704. Note that a conductive material including one or more of metal such as Cr, Mo, Ti, Ta, W, or Al or a metal compound thereof can also be used when it can be dispersed in a solution while suppressing agglomeration by means of a dispersant. A gate electrode in which a plurality of conductive films is laminated can be formed by performing film formation of a conductive material plural times by a droplet discharge method. However, as for the composition to be discharged from a nozzle hole, it is preferable to use any material selected from Au, Ag, and Cu, which is dissolved or dispersed in a solvent, taking a specific resistance value into consideration. It is more preferable to use Ag or Cu having a low resistance value. When Ag or Cu is used, a barrier film may be additionally provided as a measure for an impurity. A silicon nitride film or nickel boron (NiB) can be used as the barrier film.

In addition, a particle in which a conductive material is coated with other conductive materials to have a plurality of layers may be used. For example, a conductive particle in which Cu is coated with Ag or a three-layer structure particle in which Cu is coated with nickel boron (NiB) and then coated with Ag may be used. As for the solvents, organic solvents of esters such as butyl acetate and ethyl acetate; alcohols such as isopropyl alcohol and ethyl alcohol; methyl ethyl ketone and acetone; or the like may be used. The viscosity of the composition is preferably 20 mP·a or less. This is so that the composition can be prevented from drying or the composition can be smoothly discharged from the nozzle hole. The surface tension of the composition is preferably 40 mN/m or less. However, the viscosity of the composition and the like may be appropriately adjusted depending on a solvent to be used and intended use. For example, the viscosity of a composition in which ITO, organic indium, or organic tin is dissolved or dispersed in the solvent may be from 5 to 20 mPa·s, the viscosity of a composition in which Ag is dissolved or dispersed in the solvent may be from 5 to 20 mPa·s, and the viscosity of a composition in which Au is dissolved or dispersed in the solvent may be from 5 to 20 mPa·s.

A diameter of the nozzle hole in the droplet discharge apparatus is set in the range of 0.1 to 50 μm (favorably, 0.6 to 26 μm) and the amount of compositions to be discharged from the nozzle is set in the range of 0.00001 to 50 pl (favorably, 0.0001 to 40 pl). The discharge amount increases in proportion to the size of the diameter of the nozzle hole. Further, a distance between an object to be treated and the nozzle hole is preferably as short as possible in order to drop the droplet on a desired portion. The distance is preferably set in the range of approximately 0.1 to 2 mm. Without changing the diameter of the nozzle hole, the discharge amount can be controlled by changing pulse voltage applied to the piezoelectric element. These discharge conditions are preferably set so that a line width is approximately 10 μm or less.

In the case of using a droplet discharge method, a conductive film can be formed by dropping the conductive material dispersed in an organic solvent or an inorganic solvent from a nozzle and then drying at room temperature or baking it. Specifically, in this embodiment mode, a tetradecane solution in which Ag is dispersed is dropped and baked at a temperature of 200 to 300° C. for 1 min. to 50 hr. to remove the solvent, thereby forming the gate electrodes 701 to 703. In the case of using an organic solvent, the solvent can be efficiently removed and resistance of the gate electrodes 701 to 703 can be further lowered by performing the baking in an oxygen atmosphere. Although not shown, a scanning line connected to the gate electrode 701 can also be formed simultaneously with this step.

Figure 10B:
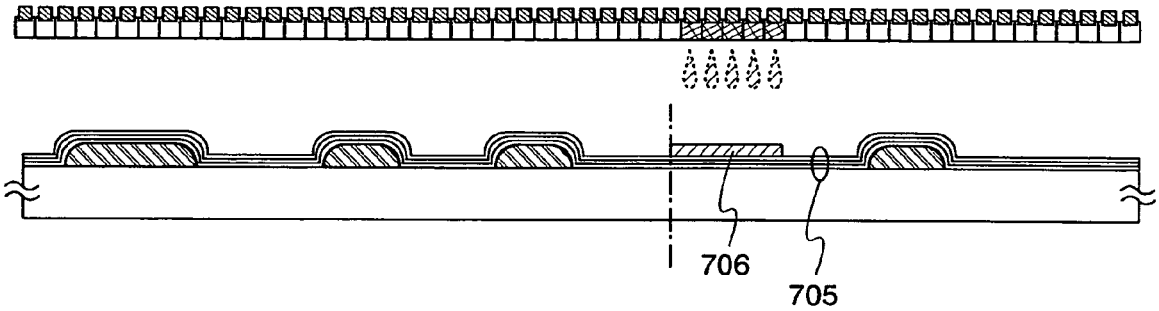

Subsequently, a gate insulating film 705 is formed to cover the gate electrodes 701 to 703 and the wiring 704 (FIG. 10B). For example, an insulating film of silicon oxide, silicon nitride, silicon nitride oxide, or the like can be used for the gate insulating film 705. A single-layer insulating film may be used or a plurality of insulating films may be laminated as the gate insulating film 705. In this embodiment mode, an insulating film in which silicone nitride, silicon oxide, and silicone nitride are sequentially laminated is used as the gate insulating film 705. A plasma CVD method, a sputtering method, or the like can be used to form the gate insulating film 705. In order to form a fine insulating film which can suppress a gate leakage current at a low film-formation temperature, a rare gas element such as argon is preferably included in a reaction gas and mixed into the insulating film to be formed. In addition, aluminum nitride can be used for the gate insulating film 705. Aluminum nitride has relatively high thermal conductivity and can efficiently radiate heat generated in a TFT.

Then, a first electrode 706 to be included in a light emitting element is formed over the gate insulating film 705 using the droplet discharge apparatus as shown in FIG. 10B. Note that the first electrode 706 and a second electrode 736 to be formed later respectively correspond to an anode and a cathode in this embodiment mode; however, the invention is not limited thereto. The first electrode 706 and the second electrode 736 may respectively correspond to a cathode and an anode.

A light-transmitting conductive oxide material such as indium tin oxide (ITO), zinc oxide (ZnO), indium zinc oxide (IZO), or zinc oxide doped with gallium (GZO) can be used for the anode. Indium tin silicon oxide (hereinafter referred to as ITSO) containing ITO and silicon oxide, or indium oxide containing silicon oxide into which zinc oxide (ZnO) of 2 to 20% is further mixed may also be used. In addition to the above-described light-transmitting conductive oxide material, a single-layer film formed of one or more of TiN, ZrN, Ti, W, Ni, Pt, Cr, Ag, Al, and the like; a laminated layer of a titanium nitride film and a film containing aluminum as its main component; a three-layer structure of a titanium nitride film, a film containing aluminum as its main component, and another titanium nitride film; or the like can be used for the anode. However, in the case of extracting light through the anode formed of a material other than the light-transmitting conductive oxide material, the anode is formed to have such a thickness as to transmit light (preferably, approximately 5 to 30 nm).

Note that the first electrode 706 can be formed by a sputtering method or a printing method as well as a droplet discharge method. In the case of using a droplet discharge method or a printing method, the first electrode 706 can be formed without using a mask. Even in the case of using a sputtering method, a mask for light exposure need not be separately prepared by forming a resist to be used in a lithography method by a droplet discharge method or a printing method, which leads to cost reduction.

The first electrode 706 may be polished by a CMP method or by cleaning with a porous body of polyvinyl alcohol so that the surface thereof is planarized. Furthermore, the surface of the first electrode 706 may be irradiated with an ultraviolet ray or may be treated with oxygen plasma after polishing by the CMP method.

Figure 10C:
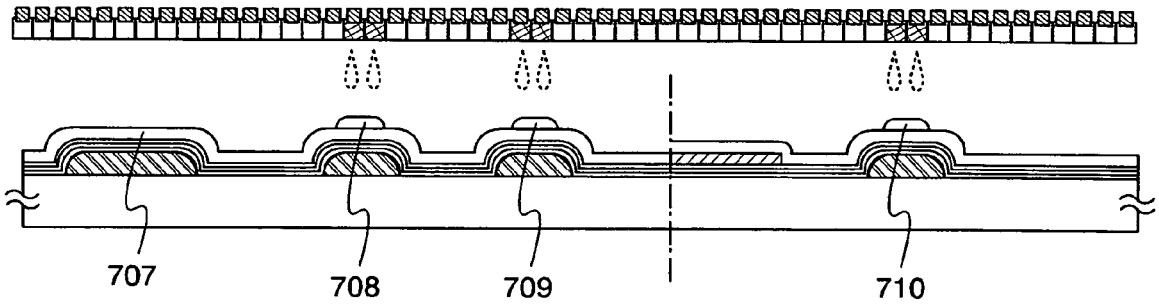

Subsequently, a first semiconductor film 707 is formed as shown in FIG. 10C. The first semiconductor film 707 can be formed of an amorphous semiconductor or a semi-amorphous semiconductor (SAS). A polycrystalline semiconductor film may also be used. In this embodiment mode, a semi-amorphous semiconductor is used for the first semiconductor film 707. A semi-amorphous semiconductor has higher crystallinity than an amorphous semiconductor, and high mobility can be obtained. Further, it can be formed without increasing the number of steps for crystallization unlike in the case of a polycrystalline semiconductor.

An amorphous semiconductor can be obtained by performing glow discharge decomposition on a silicide gas. $SiH_4$ or $Si_2H_6$ can be given as a typical silicide gas. The silicide gas may be diluted with hydrogen, or hydrogen and helium.

A SAS can also be obtained by performing glow discharge decomposition on a silicide gas. $SiH_4$ is given as a typical silicide gas. Alternatively, $Si_2H_6$, $SiH_2Cl_2$, $SiHCl_3$, $SiCl_4$, $SiF_4$, or the like can also be used as the silicide gas. The silicide gas may be diluted with hydrogen, or hydrogen to which one or more of rare gas elements of helium, argon, krypton, and neon is added, thereby making the formation of the SAS easy. It is preferable to dilute the silicide gas so that a dilution ratio thereof ranges from 2 to 1000 times. Further, the silicide gas may be mixed with a carbide gas such as $CH_4$ or $C_2H_6$, a germanide gas such as $GeH_4$ or $GeF_4$, $F_2$, or the like to adjust an energy bandwidth to 1.5 to 2.4 eV, or 0.9 to 1.1 eV. A TFT using a SAS as the first semiconductor film can have mobility of 1 to 10 $cm^2$/Vsec or more.

The first semiconductor film may be formed by laminating plural kinds of SAS formed from different gases. For example, the first semiconductor film can be formed by laminating a SAS formed using a gas containing a fluorine atom and a SAS formed using a gas containing a hydrogen atom among the above-described various gases.

Reactive formation of a film by glow discharge decomposition can be performed under reduced pressure or atmospheric pressure. Under reduced pressure, formation may be performed with pressures in the range of approximately 0.1 to 133 Pa. High-frequency powers of 1 to 120 MHz, preferably, 13 to 60 MHz may be supplied to perform glow discharge. Pressures may be in the range of approximately 0.1 to 133 Pa, and power supply frequency may be in the range of 1 to 120 MHz, preferably, 13 to 60 MHz. A substrate heating temperature is preferably 300° C. or less, preferably, 100 to 250° C. It is desirable that an atmospheric constituent impurity such as oxygen, nitrogen, or carbon is $1\times10^{20}$ atoms/$cm^3$ or less as an impurity element in the film; specifically, an oxygen concentration is $5\times10^{19}$ atoms/$cm^3$ or less, preferably, $1\times10^{19}$ atoms/$cm^3$ or less.

In the case of forming the semiconductor film using $Si_2H_6$, and $GeF_4$ or $F_2$, crystal grows in the semiconductor film from the side closer to the substrate. Therefore, the semiconductor film has higher crystallinity on the side closer to the substrate. Accordingly, in the case of a bottom gate TFT in which the gate electrode is located closer to the substrate than the first semiconductor film, a region of the first semiconductor film on the side closer to the substrate and having high crystallinity can be used as a channel formation region. Thus, the mobility can preferably be further increased.

In the case of forming the semiconductor film using $SiH_4$ and $H_2$, a large crystal grain can be obtained in the semiconductor film on the side closer to a top surface. Accordingly, in the case of a top gate TFT in which the first semiconductor film is located closer to the substrate than the gate electrode, a region of the first semiconductor film on the side farther from the substrate and having high crystallinity can be used as a channel formation region. Thus, the mobility can preferably be further increased.

The SAS exhibits weak n-type conductivity when an impurity intended to control valence electrons is intentionally not added. This is because glow discharge is performed using higher power than in the case of forming an amorphous semiconductor and oxygen tends to be mixed into the semiconductor film. Thus, a threshold value can be controlled by adding an impurity imparting p-type conductivity to the first semiconductor film provided with a channel formation region of the TFT at the same time as formation thereof or after the formation. A typical impurity imparting p-type conductivity is boron, and an impurity gas such as $B_2H_6$ or $BF_3$ is preferably mixed into a silicide gas at the rate of 1 to 1000 ppm. For example, in the case of using boron as an impurity imparting p-type conductivity, the concentration of boron is preferably $1\times10^{14}$ to $6\times10^{16}$ atoms/$cm^3$.

Then, protective films 708 to 710 are formed over the first semiconductor film 707 so as to overlap a portion to be a channel formation region in the first semiconductor film 707. The protective films 708 to 710 may be formed by a droplet discharge method or a printing method, or may be formed by a CVD method, a sputtering method, or the like. An inorganic insulating film of silicon oxide, silicon nitride, silicon nitride oxide, or the like, a siloxane insulating film, or the like can be used as the protective films 708 to 710. These films may be laminated and used as the protective films 708 to 710. In this embodiment mode, a silicon nitride film formed by a plasma CVD method and a siloxane insulating film formed by a droplet discharge method are laminated and used as the protective films 708 to 710. In this case, the silicon nitride film can be patterned using the siloxane insulating film formed by a droplet discharge method as a mask.

Figure 10D:
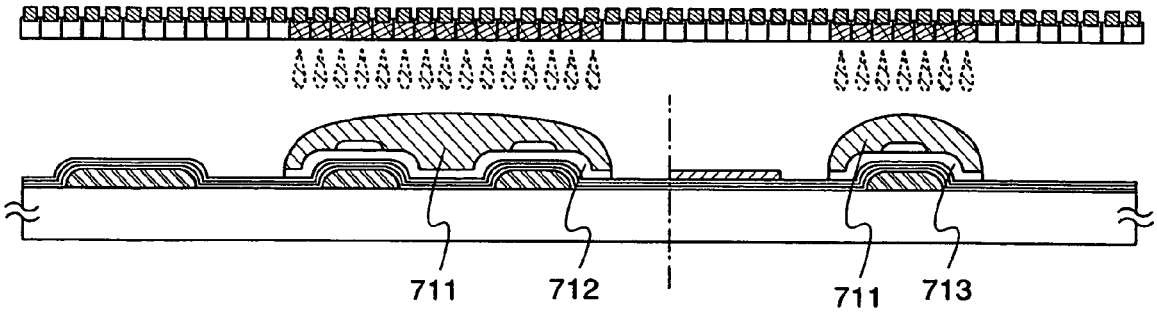

Subsequently, the first semiconductor film 707 is patterned as shown in FIG. 10D. The first semiconductor film 707 may be patterned using a lithography method or using a resist formed by a droplet discharge method or a printing method as a mask. In the latter case, a mask for light exposure need not be separately prepared, which leads to cost reduction. In this embodiment mode, an example, in which patterning is performed using a resist 711 formed by a droplet discharge method, is described. Note that an organic resin such as polyimide or acrylic can be used for the resist 711. Then, patterned first semiconductor films 712 and 713 are formed by dry etching using the resist 711.

Figure 11A:
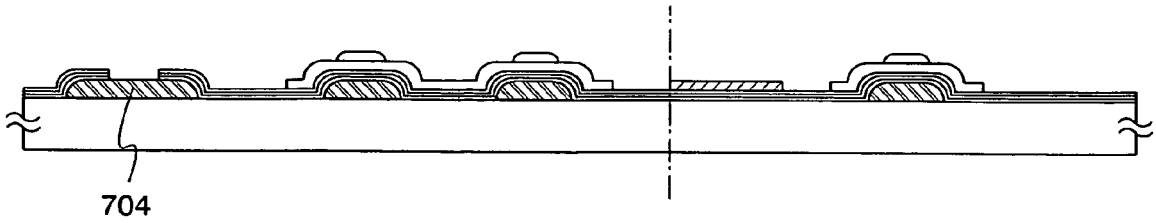
FIGS. 11A to 11D show a method for manufacturing a display device with the use of a droplet discharge apparatus.

Subsequently, a part of the gate insulating film 705 is selectively removed by etching to expose a part of the wiring 704 as shown in FIG. 11A. The gate insulating film 705 may be etched using a lithography method or using a resist formed by a droplet discharge method or a printing method as a mask. In the latter case, a mask for light exposure need not be separately prepared, which leads to cost reduction.

Figure 11B:
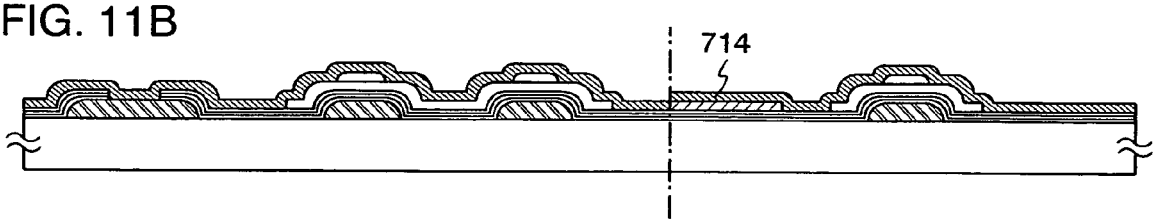

Subsequently, a second semiconductor film 714 is formed to cover the patterned first semiconductor films 712 and 713 as shown in FIG. 11B. The second semiconductor film 714 is doped with an impurity imparting one conductivity. In the case of forming a p-channel TFT, an impurity gas such as $B_2H_6$ or $BF_3$ is preferably mixed into a silicide gas as an impurity imparting p-type conductivity. For example, in the case of using boron as an impurity imparting p-type conductivity, the concentration of boron is preferably $1\times10^{14}$ to $6\times10^{16}$ atoms/cm$^3$. In the case of forming an n-channel TFT, an impurity imparting n-type conductivity, for example, phosphorus may be added to the second semiconductor film 714. Specifically, an impurity gas such as $PH_3$ may be added to a silicide gas to form the second semiconductor film 214. The second semiconductor film 714 having one conductivity can be form of a semi-amorphous semiconductor or an amorphous semiconductor as in the case of the first semiconductor films 712 and 713.

Note that the second semiconductor film 714 is formed in contact with the first semiconductor films 712 and 713 in this embodiment mode; however, the invention is not limited thereto. A third semiconductor film serving as an LDD region may be formed between the first semiconductor films 712 and 713 and the second semiconductor film 714. In this case, the third semiconductor film is formed of a semi-amorphous semiconductor or an amorphous semiconductor.

Figure 11C:
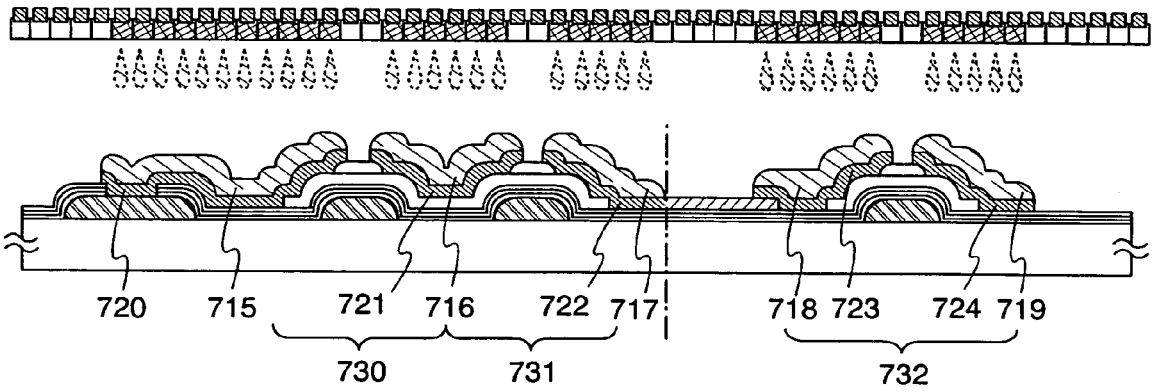

Subsequently, wirings 715 to 719 are formed using a droplet discharge method, and the second semiconductor film 714 is etched using the wirings 715 to 719 as a mask as shown in FIG. 11C. The second semiconductor film 714 can be etched by dry etching in a vacuum or under atmospheric pressure. According to the etching, semiconductor films 720 to 724 serving as a source region or a drain region are formed from the second semiconductor film 714; further, a part of the first electrode 706 is exposed. When the second semiconductor film 714 is etched, the first semiconductor films 712 and 713 are prevented from being overetched due to the protective films 708 to 710.

The wirings 715 to 719 can be formed as in the case of the gate electrodes 701 to 703. Specifically, a conductive material including one or more of metal such as Ag, Au, Cu, or Pd or a metal compound thereof is used. In the case of using a droplet discharge method, the wirings 715 to 719 can be formed by dropping the conductive material dispersed in an organic or inorganic solvent from a nozzle and then drying at room temperature or baking it. A conductive material having one or more of metal such as Cr, Mo, Ti, Ta, W, or Al or a metal compound thereof can also be used when it can be dispersed in a solution while suppressing agglomeration by means of a dispersant. The baking may be performed in an oxygen atmosphere to lower the resistance of the wirings 715 to 719. The wirings 715 to 719 in which a plurality of conductive films is laminated can be formed by forming conductive material films plural times by a droplet discharge method or various printing methods.

According to the above steps, TFTs 730 to 732 are formed.

Figure 11D:
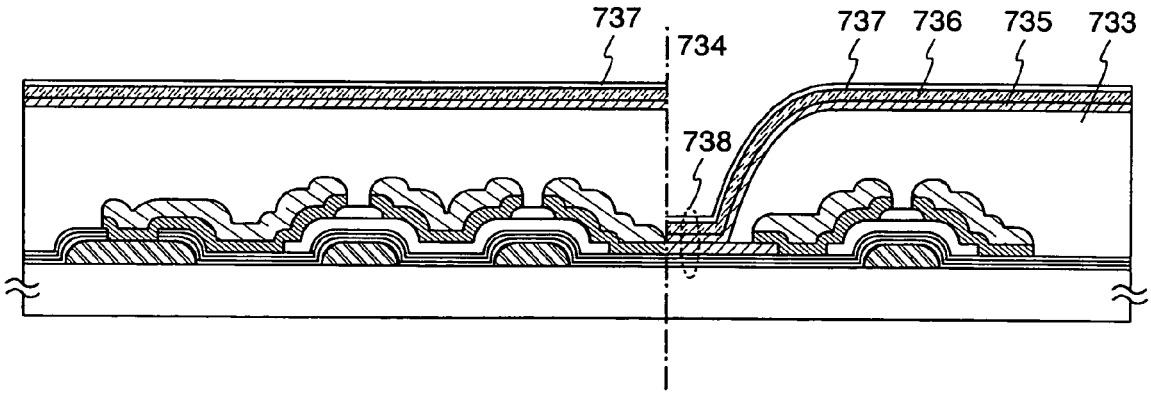

Subsequently, a partition wall 733 is formed to cover the TFTs 730 to 732 and an edge portion of the first electrode 706 as shown in FIG. 11D. The partition wall 733 can be formed using an organic resin film, an inorganic insulating film, or a siloxane insulating film. For the organic resin film, acrylic, polyimide, polyamide, or the like can be used. For the inorganic film, silicon oxide, silicon nitride oxide, or the like can be used. The first electrode 706 can be prevented from connecting to a second electrode 736 to be formed later, particularly by using a photosensitive organic resin film as the partition wall 733, forming an opening 734 above the first electrode 706, and forming a side wall in the opening 734 to be a slope with a continuous curvature. At this time, a mask can be formed by a droplet discharge method or a printing method. Further, the partition wall 733 itself can also be formed by a droplet discharge method. Note that the partition wall 733 has the opening 734.

Subsequently, heat treatment under an atmospheric pressure or heat treatment in a vacuum (vacuum bake) may be performed to remove moisture, oxygen, or the like absorbed to the partition wall 733 and the first electrode 706 before forming an electroluminescent layer 735. Specifically, heat treatment is performed in a vacuum at a substrate temperature of 200 to 450° C., preferably, 250 to 300° C. for approximately 0.5 to 20 hours. The pressure is preferably $3\times10^{-7}$ Torr or less, and most preferably, $3\times10^{-8}$ Torr or less, when possible. In the case of forming the electroluminescent layer after performing heat treatment in a vacuum, reliability can be further improved by keeping the substrate in a vacuum until right before forming the electroluminescent layer. In addition, the first electrode 706 may be irradiated with ultraviolet rays before or after the vacuum bake.

In this embodiment mode, a passivation film 737 to be formed later is formed of silicone nitride and is in contact with the second electrode 706. When the first electrode or the second electrode of the light emitting element is formed using indium tin silicon oxide (ITSO) containing ITO and silicon oxide film, or the like to be in contact with an insulating film containing silicon nitride or silicon nitride oxide, luminance of the light emitting element can be more improved than the case of using any combination of the above-described materials. When ITSO is used for the first electrode 706, moisture tends to attach due to silicon oxide contained therein; therefore, the above-described vacuum bake is particularly effective.

Then, the electroluminescent layer 735 is formed in contact with the first electrode 706 in the opening 734 of the partition wall 733. The electroluminescent layer 735 may have either a single-layer structure or a laminated structure of a plurality of layers. In the case of having a laminated structure of a plurality of layers, a hole injection layer, a hole transport layer, a light emitting layer, an electron transport layer, and an electron injection layer are sequentially laminated over the first electrode 706 corresponding to an anode. When the first electrode 706 corresponds to a cathode, the electroluminescent layer 735 is formed by sequentially laminating an electron injection layer, an electron transport layer, a light emitting layer, a hole transport layer, and a hole injection layer.

In the case of displaying a monochrome image, or in the case of displaying a color image using a white light emitting element and a color filter, each electroluminescent layer 735 has the same structure in all pixels. In the case of displaying a color image using three light emitting elements which emit light of respective three primary colors, the electroluminescent layer 735 may be separately colored by changing materials, layers to be laminated, or thicknesses for each color. In the case of separately coloring the electroluminescent layer, a droplet discharge method is extremely effective since a material is not wasted and steps can be simplified. Note that "color" may be a full color using a mixed color or an area color using a plurality of pixels each having a single hue for specific area.

A color filter includes a colored layer which can transmit light having a specific wavelength region, and in some cases, a shielding film which can shield visible light in addition to the colored layer. The color filter may be formed over a cover material for sealing a light emitting element or may be formed over an element substrate. In either case, the colored layer or the shielding film can be formed by a printing method or a droplet discharge method.

The electroluminescent layer 735 can be formed by a droplet discharge method even in the case of using any of a high molecular weight organic compound, an intermediate molecular weight organic compound, a low molecular weight organic compound, and an inorganic compound. The intermediate molecular weight organic compound, the low molecular weight organic compound, or the inorganic compound may be formed by an evaporation method.

Then, the second electrode 736 is formed to cover the electroluminescent layer 735. In this embodiment mode, the second electrode 736 corresponds to a cathode. The second electrode 736 is preferably manufactured by appropriately using an evaporation method, a sputtering method, a droplet discharge method, or the like depending on materials.

As a cathode, metal, an alloy, a conductive compound, or a mixture thereof, having a low work function, can be used. Specifically, alkali metal such as Li or Cs, alkaline earth metal such as Mg, Ca, or Sr, an alloy including the metal (Mg:Ag, Al:Li, Mg:In, or the like), a compound thereof ($CaF_2$ or CaN), or rare earth metal such as Yb or Er can be used. In the case of providing an electron injection layer, another conductive layer of Al or the like can also be used. In the case of extracting light through the cathode, a light-transmitting conductive oxide material such as indium tin oxide (ITO), zinc oxide (ZnO), indium zinc oxide (IZO), or zinc oxide doped with gallium (GZO) can be used. Indium tin silicon oxide (hereinafter referred to as ITSO) containing ITO and silicon oxide, or indium oxide containing silicon oxide into which zinc oxide (ZnO) of 2 to 20% is further mixed may also be used. When the light-transmitting conductive oxide material is used, the electroluminescent layer 735 is preferably provided with an electron injection layer. Without using the light-transmitting conductive oxide material, light can be extracted through the cathode by forming the cathode to have such a thickness as to transmit light (preferably, approximately 5 to 30 nm). In this case, sheet resistance of the cathode may be suppressed by forming a light-transmitting conductive layer using a light-transmitting conductive oxide material to be in contact with an upper surface or a lower surface of the cathode.

The first electrode 706, the electroluminescent layer 735, and the second electrode 736 overlap in the opening 734 of the partition wall 733, thereby forming a light emitting element 738.

Note that light from the light emitting element 738 may be extracted through the first electrode 706, the second electrode 736, or both of them. Materials and thicknesses for respective anode and cathode are selected in accordance with a desired structure among the above-described three structures. In the case of extracting light through the second electrode 736 as in this embodiment mode, higher luminance can be obtained with less power consumption than in the case of extracting light through the first electrode 706.

Note that the passivation film 737 may be formed to cover the light emitting element 738. A film which is less permeated by a substance such as moisture or oxygen causing promotion of deterioration in the light emitting element, compared to other insulating films, is used as the passivation film 737. Typically, it is preferable to use, for example, a DLC film, a carbon nitride film, a silicon nitride film formed by a method such as an RF sputtering method or a CVD method, or the like. Further, for example, a laminated film of carbon nitride and silicon nitride, a laminated film of the same and polystylene, or the like may be used as the passivation film 737. In addition, a lamination of the film which is less permeated by a substance such as moisture or oxygen and a film which is more easily permeated by a substance such as moisture or oxygen but has a low internal stress, compared to the film, can be used as the passivation film 737. In this embodiment mode, silicon nitride is used. In the case of using silicon nitride for the passivation film 737, a rare gas element such as argon is preferably contained in a reactive gas and mixed into the passivation film 737 to form the dense passivation film 737 at a low film formation temperature.

Practically, it is preferable to perform packaging (sealing) with a protective film (such as a laminate film or an ultraviolet curing resin film) or a cover material having high air-tightness and less degasification after completion to the state shown in FIG. 11D in order to prevent further exposure to outside air.

Although the step of forming a pixel portion is explained in this embodiment mode, a scanning line driver circuit can be formed over the same substrate as the pixel portion when a semi-amorphous semiconductor is used for the first semiconductor film. In addition, a pixel portion may be formed with a TFT using an amorphous semiconductor, and a separately formed driver circuit may be attached to a substrate provided with the pixel portion.

Figure 12A:
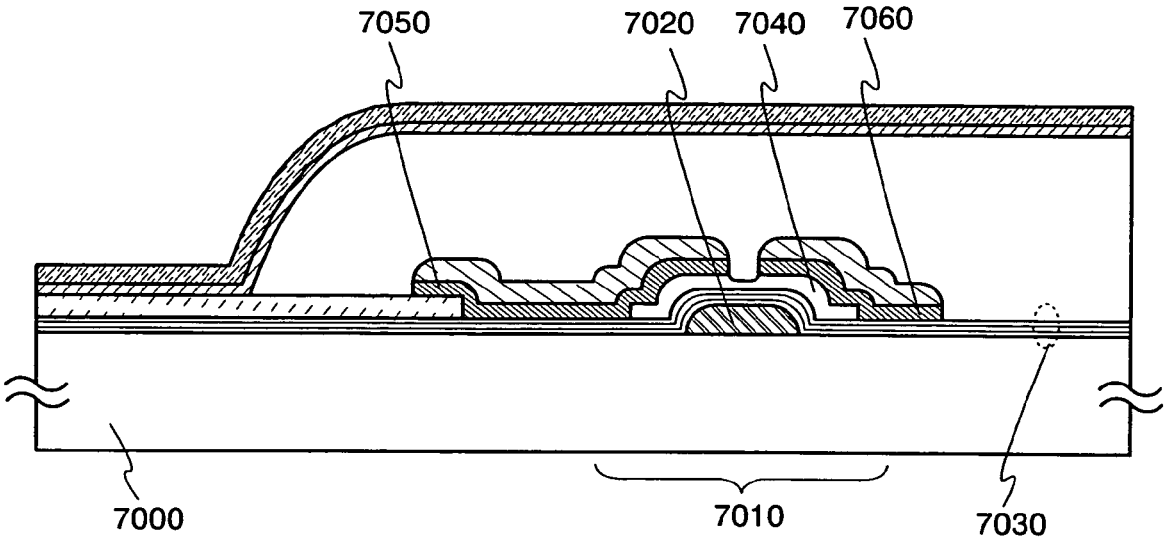
FIGS. 12A and 12B show a method for manufacturing a display device with the use of a droplet discharge apparatus.
Figure 12B:
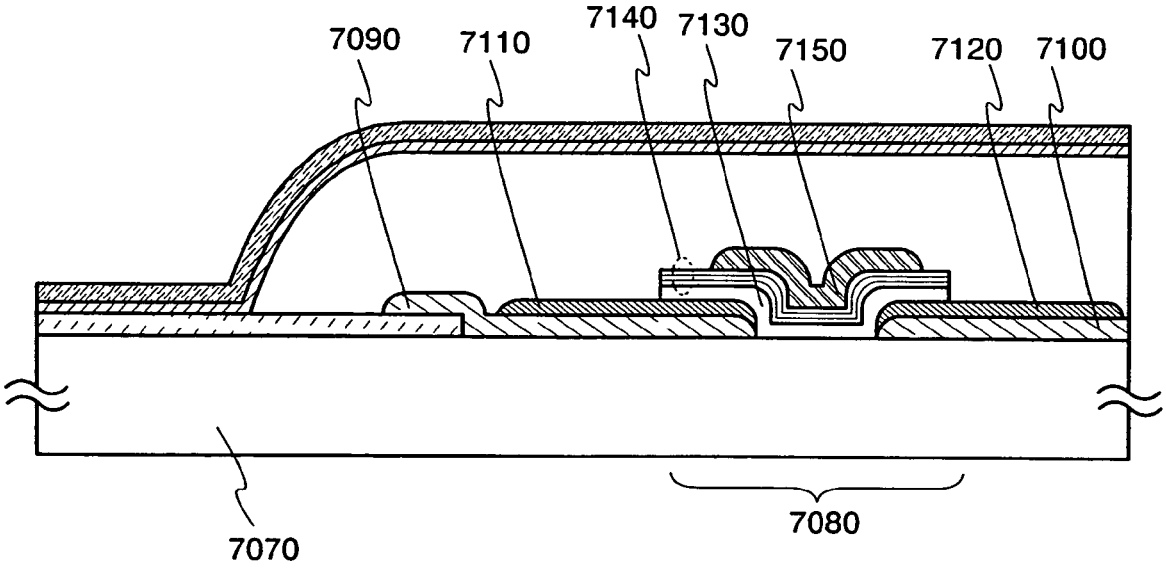

In the display device shown in FIGS. 10A to 11D, the protective film is formed between the first semiconductor film and the second semiconductor film of the TFT; however, this embodiment mode is not limited to this structure. The protective film may not necessarily be formed in the case shown in FIGS. 10A to 11D. FIG. 12A is a cross-sectional view of a pixel in the case where the protective film is not formed. A TFT 7010 shown in FIG. 12A includes a gate electrode 7020 formed over a substrate 7000, a gate insulating film 7030 formed to cover the gate electrode 7020, a first semiconductor film 7040 formed over the gate insulating film 7030 to overlap the gate electrode 7020, and second semiconductor films 7050 and 7060 in contact with the first semiconductor film 7040. When the second semiconductor films 7050 and 7060 are formed by etching, a fluoride gas such as $SF_6$, $NF_3$, or $CF_4$ is used as an etching gas. Since this etching cannot have a sufficient selection ratio to etching of the first semiconductor film 7040, processing time is appropriately adjusted. According to this etching, a part of the first semiconductor film 7040 is exposed.

When a protective film is not formed as shown in FIG. 12A and the first semiconductor film 7040 and the second semiconductor films 7050 and 7060 are patterned using the same mask, the gate insulating film 7030, the first semiconductor film 7040, and the second semiconductor films 7050 and 7060 can be continuously formed without exposing to atmospheric air. In other words, each laminate interface can be formed without being contaminated with an atmospheric constituent or contaminant floating in atmospheric air; thus, variations in TFT characteristics can be reduced.

In FIGS. 10A to 12A, the gate electrode is formed closer to the substrate than the first semiconductor film; however, this embodiment mode is not limited to this structure. FIG. 12B is a cross-sectional view of a pixel in the case where the first semiconductor film is formed closer to the substrate than the gate electrode. Note that FIG. 12B shows a TFT 7080. In FIG. 12B, wirings 7090 and 7100 are formed over a substrate 7070, second semiconductor films 7110 and 7120 are formed over the wirings 7090 and 7100, and a first semiconductor film 7130 is formed over the second semiconductor films 7110 and 7120. A gate insulating film 7140 is formed over the first semiconductor film 7130, and a gate electrode 7150 is formed over the gate insulating film 7140 to overlap the first semiconductor film 7130.

Although all of the TFTs shown in FIGS. 10A to 12B use the second semiconductor films serving as a source region or a drain region, the second semiconductor film need not necessarily be formed. In this case, the wiring is directly connected to the first semiconductor film, and the wiring serves as a source region or a drain region. When the TFT shown in FIG. 10B does not use the second semiconductor film, a mask used for patterning to form the second semiconductor films 7110 and 7120 is unnecessary. Therefore, the number of steps can be drastically reduced.

Note that this embodiment mode can be freely combined with any of the above-described embodiment modes.

Embodiment Mode 9

Examples of electronic devices formed using a droplet discharge apparatus of the invention are as follows: a camera such as a video camera or a digital camera, a goggle type display (head mounted display), a navigation system, an audio reproducing device (car audio, an audio component, or the like), a computer, a game machine, a portable information terminal (a mobile computer, a cellular phone, a portable game machine, an electronic book, or the like), an image reproducing device including a recording medium (specifically, a device capable of processing data in a recording medium such as a Digital Versatile Disk (DVD) and having a display that can display the image of the data), and the like. Practical examples thereof are shown in FIGS. 13A to 13H.

Figure 13A:
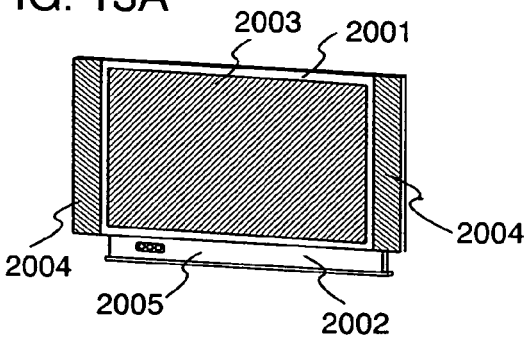
FIGS. 13A to 13H show electronic devices formed using a droplet discharge apparatus.

FIG. 13A shows a television set, which includes a chassis 2001, a supporting section 2002, a display portion 2003, a speaker portion 2004, a video input terminal 2005, and the like. The television set can be manufactured by using the droplet discharge apparatus described in the above embodiment mode to process the display portion 2003, a circuit, or the like.

Figure 13B:
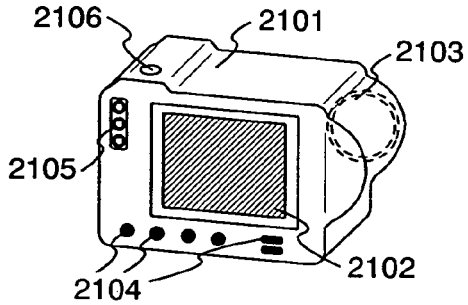

FIG. 13B shows a digital camera, which includes a main body 2101, a display portion 2102, an image receiving portion 2103, operation keys 2104, an external connection port 2105, a shutter 2106, and the like. The digital camera can be manufactured by using the droplet discharge apparatus described in the above embodiment mode to process the display portion 2102, a circuit, or the like.

Figure 13C:
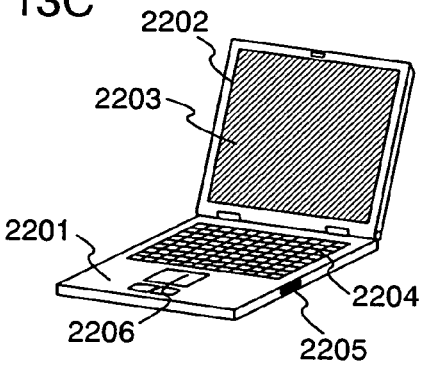

FIG. 13C shows a computer, which includes a main body 2201, a chassis 2202, a display portion 2203, a keyboard 2204, an external connection port 2205, a pointing mouse 2206, and the like. The computer can be manufactured by using the droplet discharge apparatus described in the above embodiment mode to process the display portion 2203, a circuit, or the like.

Figure 13D:
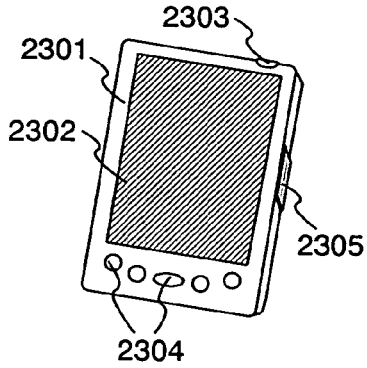

FIG. 13D shows a mobile computer, which includes a main body 2301, a display portion 2302, a switch 2303, operation keys 2304, an infrared port 2305, and the like. The mobile computer can be manufactured by using the droplet discharge apparatus described in the above embodiment mode to process the display portion 2302, a circuit, or the like.

Figure 13E:
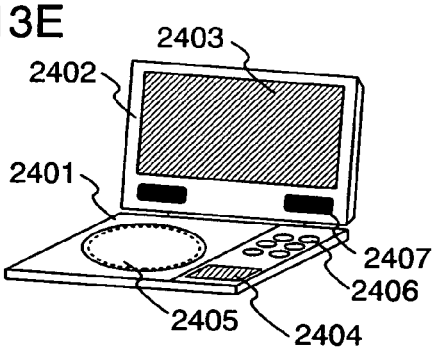

FIG. 13E shows a portable image reproducing device having a recording medium (such as a DVD reproducing device), which includes a main body 2401, a chassis 2402, a display portion A 2403, a display portion B 2404, a recording medium (a DVD or the like) reading portion 2405, operation keys 2406, a speaker portion 2407, and the like. The display portion A 2403 mainly displays image information, whereas the display portion B 2404 mainly displays text information. The image reproducing device can be manufactured by using the droplet discharge apparatus described in the above embodiment mode to process the display portion A 2403, the display portion B 2404, a circuit, or the like. Note that the image reproducing device having a recording medium includes a game machine or the like.

Figure 13F:
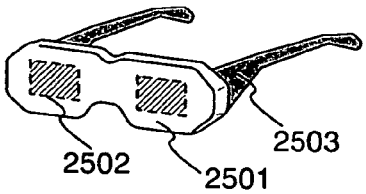

FIG. 13F shows a goggle type display (head mounted display), which includes a main body 2501, display portions 2502, and arm portions 2503. The goggle type display can be manufactured by using the droplet discharge apparatus described in the above embodiment mode to process the display portions 2502, a circuit, or the like.

Figure 13G:
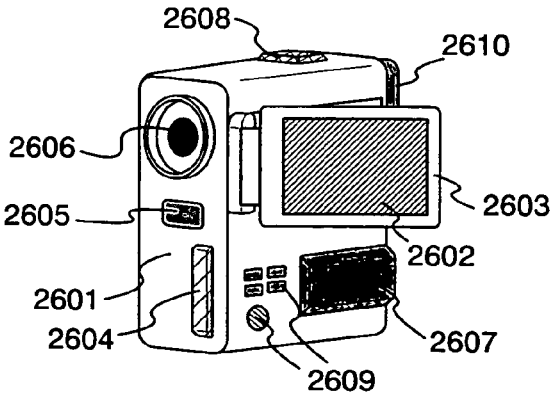

FIG. 13G shows a video camera, which includes a main body 2601, a display portion 2602, a chassis 2603, an external connection port 2604, a remote control receiving portion 2605, an image receiving portion 2606, a battery 2607, an audio input portion 2608, operation keys 2609, an eye piece portion 2610, and the like. The video camera can be manufactured by using the droplet discharge apparatus described in the above embodiment mode to process the display portion 2602, a circuit, or the like.

Figure 13H:
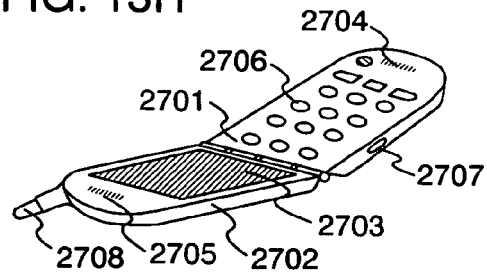

FIG. 13H shows a cellular phone, which includes a main body 2701, a chassis 2702, a display portion 2703, an audio input portion 2704, an audio output portion 2705, operation keys 2706, an external connection port 2707, an antenna 2708, and the like. The cellular phone can be manufactured by using the droplet discharge apparatus described in the above embodiment mode to process the display portion 2703, a circuit, or the like.

Note that the droplet discharge apparatus can also be used for a front or rear projector as well as the above-described electronic devices.

As described above, the applicable range of the present invention is so wide that the invention can be applied to electronic devices in various fields. Note that this embodiment mode can be freely combined with any of the above-described embodiment modes.

This application is based on Japanese Patent Application serial No. 2004-242862 filed in Japan Patent Office on Aug. 23, 2004, the entire contents of which are hereby incorporated by reference.

What is claimed is:

1. A droplet discharge apparatus comprising:

a nozzle portion including at least a nozzle hole for discharging a composition and a pressurizing means for discharging the composition from the nozzle hole; and a means for supplying the composition to a bottom surface of the nozzle portion, wherein a lyophilic treatment is performed on the bottom surface of the nozzle portion, and wherein the composition is exchanged between the nozzle hole and the means for supplying the composition.

2. A droplet discharge apparatus according to claim 1, wherein the means for supplying the composition includes a channel provided in the nozzle portion, and the composition is supplied to the bottom surface of the nozzle portion through the channel.

3. A droplet discharge apparatus according to claim 2, wherein the channel includes a means for supplying the composition to the bottom surface of the nozzle portion or a means for suctioning the composition from the bottom surface of the nozzle portion.

4. A droplet discharge apparatus comprising:

a nozzle portion including at least a plurality of nozzle holes for discharging a composition, and a pressurizing means for discharging the composition from the plurality of nozzle holes, wherein the nozzle portion is arranged in a linear shape; and a means for supplying the composition to a bottom surface of the nozzle portion, wherein a lyophilic treatment is performed on the bottom surface of the nozzle portion, and wherein the composition is exchanged between the plurality of nozzle holes and the means for supplying the composition.

5. A droplet discharge apparatus according to claim 4, wherein the means for supplying the composition includes a plurality of channels provided in the nozzle portion, and the composition is supplied to the bottom surface of the nozzle portion though the plurality of channels.

6. A droplet discharge apparatus according to claim 5, wherein each of the plurality of channels is provided between the plurality of nozzle holes arranged in a linear shape.

7. A droplet discharge apparatus according to claim 5 or 6, wherein each of the plurality of channels includes a means for supplying the composition to the bottom surface of the nozzle portion or a means for suctioning the composition from the bottom surface of the nozzle portion.

8. A droplet discharge apparatus comprising:

a nozzle portion including at least a nozzle hole for discharging a composition, a pressurizing means for discharging the composition from the nozzle hole, and a channel connected to a side wall of the nozzle hole, wherein the composition is exchanged between the nozzle hole and the channel.

9. A droplet discharge apparatus comprising:

a nozzle portion including at least a nozzle hole for discharging a composition, a pressurizing means for discharging the composition from the nozzle hole, and first and second channels each connected to a side wall of the nozzle hole, wherein the composition is exchanged between the nozzle hole and at least one of the first and second channels.

10. A droplet discharge apparatus according to claim 9, wherein on-off valves are provided in a connection portion between the nozzle hole and the first channel and in a connection portion between the nozzle hole and the second channel.

11. A droplet discharge apparatus comprising:

a nozzle portion including at least a plurality of nozzle holes for discharging a composition, a pressurizing means for discharging the composition from the plurality of nozzle holes, and a channel connected to a side wall of the plurality of nozzle holes, wherein the nozzle portion is arranged in a linear shape, wherein the channel connects the plurality of nozzle holes with each other, and the composition is exchanged between the plurality of nozzle holes and the channel.

12. A droplet discharge apparatus according to any one of claims 8 to 11, wherein the channel includes a means for supplying the composition to the nozzle hole or a means for suctioning the composition from the nozzle hole.

13. A droplet discharge apparatus comprising:

a nozzle hole for discharging a composition;

a compression chamber connected to the nozzle hole;

a channel connected to two different positions of a side wall of the compression chamber;

a first pressurizing means provided on a side wall of the compression chamber; and a second pressurizing means provided on a side wall of the channel, wherein an on-off valve is provided in a connection portion between the compression chamber and the channel.

14. A droplet discharge apparatus according to claim 13, wherein the channel is provided with a means for externally supplying the composition.

15. A droplet discharge apparatus comprising:

a nozzle portion including at least a nozzle hole for discharging a composition and a pressurizing means for discharging the composition from the nozzle hole;

a means for supplying the composition to a bottom surface of the nozzle portion; and a means for supplying vapor, wherein the means for supplying vapor supplies a vapor of a solvent of the composition to the droplet discharge apparatus.

16. A droplet discharge apparatus comprising:

a droplet discharge means including at least a nozzle hole for discharging a composition, a compression chamber connected to the nozzle hole, a vibrating means, and a pressurizing means in contact with the compression chamber, wherein the pressurizing means and the vibrating means vibrate the composition included in the droplet discharge means.

17. A droplet discharge apparatus comprising:

a nozzle portion including at least a nozzle hole for discharging a composition and a pressurizing means for discharging the composition from the nozzle hole; and a means for supplying the composition from a different direction in which the composition is discharged, wherein the composition is exchanged between the nozzle hole and the means for supplying the composition.

18. A droplet discharge apparatus according to claim 17, wherein the means for supplying the composition includes a channel provided in the nozzle portion, and the composition is supplied to the bottom surface of the nozzle portion through the channel.

19. A droplet discharge apparatus according to claim 18, wherein the channel includes a means for supplying the composition to the bottom surface of the nozzle portion or a means for suctioning the composition from the bottom surface of the nozzle portion.

20. A droplet discharge apparatus comprising:

a nozzle portion including at least a plurality of nozzle holes for discharging a composition, and a pressurizing means for discharging the composition from the plurality of nozzle holes, wherein the nozzle portion is arranged in a linear shape; and a means for supplying the composition from a different direction in which the composition is discharged, wherein the composition is exchanged between the plurality of nozzle holes and the means for supplying the composition.

21. A droplet discharge apparatus according to claim 20, wherein the means for supplying the composition includes a plurality of channels provided in the nozzle portion, and the composition is supplied to the bottom surface of the nozzle portion through the plurality of channels.

22. A droplet discharge apparatus according to claim 21, wherein each of the plurality of channels is provided between the plurality of nozzle holes arranged in a linear shape.

23. A droplet discharge apparatus according to claim 21 or 22, wherein each of the plurality of channels includes a means for supplying the composition to the bottom surface of the nozzle portion or a means for suctioning the composition from the bottom surface of the nozzle portion.

* * * * *